US009442410B2

(12) United States Patent
Makishima

(10) Patent No.: US 9,442,410 B2
(45) Date of Patent: Sep. 13, 2016

(54) IMAGE FORMING APPARATUS, IMAGE FORMING METHOD, AND NON-TRANSITORY COMPUTER READABLE MEDIUM

(71) Applicant: FUJI XEROX CO., LTD, Minato-ku, Tokyo (JP)

(72) Inventor: Yoshinori Makishima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/322,978

(22) Filed: Jul. 3, 2014

(65) Prior Publication Data

US 2015/0109397 A1 Apr. 23, 2015

(30) Foreign Application Priority Data

Oct. 22, 2013 (JP) ..... 2013-219408

(51) Int. Cl.
*G03G 15/043* (2006.01)
*G03G 15/00* (2006.01)

(52) U.S. Cl.
CPC ..... *G03G 15/043* (2013.01); *G03G 15/5033* (2013.01); *G03G 15/5058* (2013.01); *G03G 15/5062* (2013.01); *G03G 15/5037* (2013.01)

(58) Field of Classification Search
CPC ..... G03G 15/043; G03G 15/5033; G03G 15/5062; G03G 15/5058; G03G 15/5037
See application file for complete search history.

(56) References Cited

U.S. PATENT DOCUMENTS 7,876,342 B2 * 1/2011 Nishikawa et al. ..... 347/116

FOREIGN PATENT DOCUMENTS

| | | | |
|---|---|---|---|
| JP | 9-281419 A | | 10/1997 |
| JP | 2002-82302 A | | 3/2002 |
| JP | 2002082302 A | * | 3/2002 |
| JP | 2003-270877 A | | 9/2003 |

* cited by examiner

*Primary Examiner* — Sarah Al Hashimi
(74) *Attorney, Agent, or Firm* — Sughrue Mion, PLLC

(57) ABSTRACT

An image forming apparatus includes a latent image forming unit, a developing unit, a transfer unit, a detector, an adjustment unit, and a controller. The latent image forming unit concentrates a beam emitted from a light source onto a surface of a photoconductor and forms a latent image on the surface of the photoconductor. The developing unit develops the latent image on the surface of the photoconductor to form a toner image. The transfer unit transfers the toner image on the surface of the photoconductor onto a transferred-image receiving member. The detector detects a potential of the latent image or a density of the toner image. The adjustment unit adjusts a focusing state of the concentrated beam on the photoconductor. The controller controls the adjustment unit in accordance with a result of detecting the potential of the latent image or the density of the toner image.

20 Claims, 19 Drawing Sheets

IMAGE FORMING APPARATUS, IMAGE FORMING METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2013-219408 filed Oct. 22, 2013.

BACKGROUND

Technical Field

The present invention relates to an image forming apparatus, an image forming method, and a non-transitory computer readable medium.

SUMMARY

According to an aspect of the invention, there is provided an image forming apparatus including a latent image forming unit, a developing unit, a transfer unit, a detector, an adjustment unit, and a controller. The latent image forming unit includes a light source and a condenser, and concentrates a beam emitted from the light source onto a surface of a photoconductor and forms a latent image on the surface of the photoconductor. The developing unit develops the latent image on the surface of the photoconductor to form a toner image. The transfer unit transfers the toner image on the surface of the photoconductor onto a transferred-image receiving member. The detector detects a potential of the latent image or a density of the toner image. The adjustment unit adjusts a focusing state of the concentrated beam on the photoconductor. The controller controls the adjustment unit in accordance with a result of detecting the potential of the latent image or the density of the toner image.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described in detail below with reference to the accompanying drawings.

First Exemplary Embodiment

Figure 1:
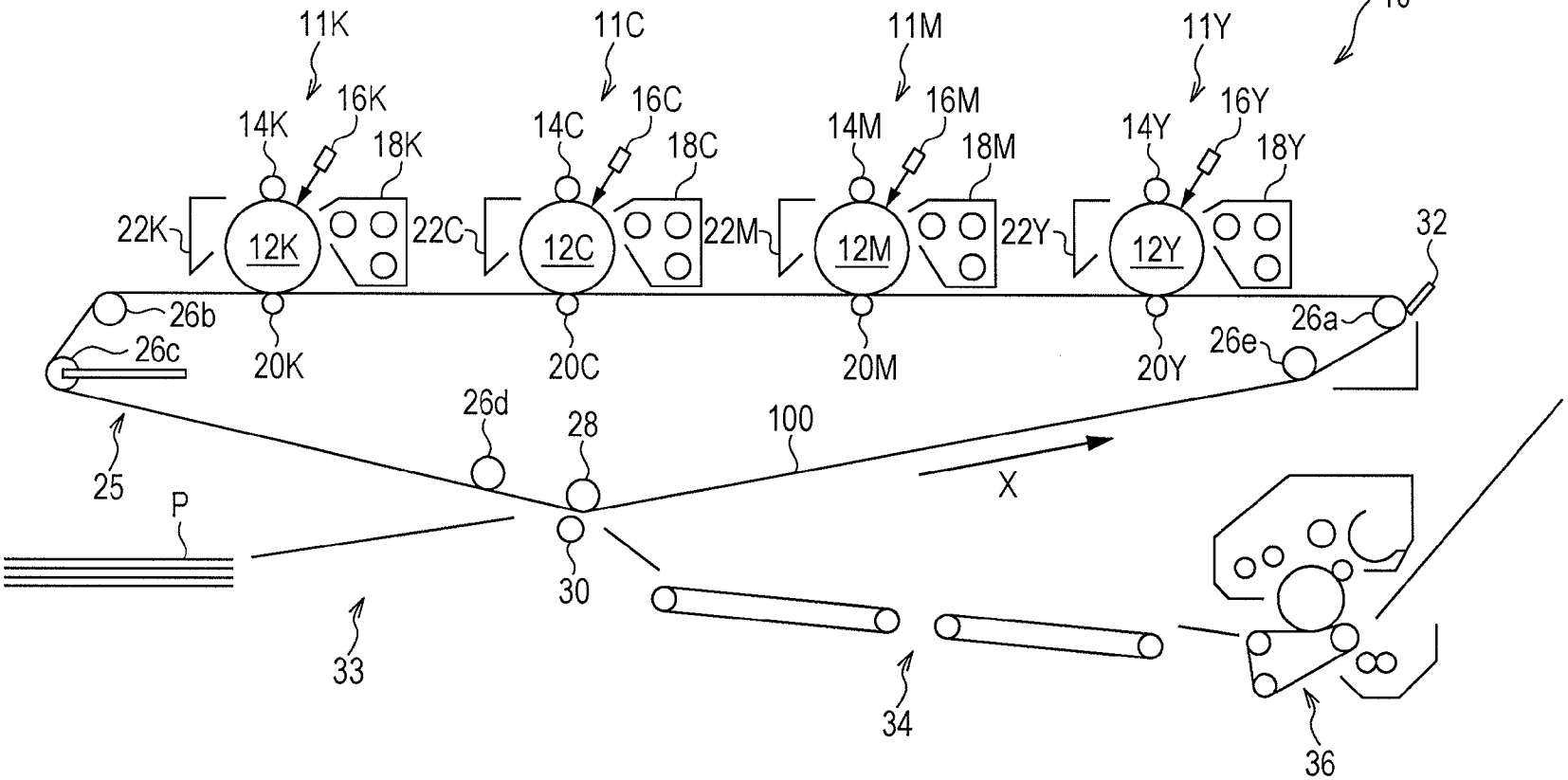
FIG. 1 illustrates a schematic configuration of an example of an image forming apparatus according to a first exemplary embodiment.

An image forming apparatus according to a first exemplary embodiment of the present invention will be described first. FIG. 1 illustrates a schematic configuration of an example of the image forming apparatus according to the first exemplary embodiment.

An image forming apparatus 10 includes an image forming unit 11Y for yellow, an image forming unit 11M for magenta, an image forming unit 11C for cyan, and an image forming unit 11K for black. The image forming units 11Y, 11M, 11C, and 11K respectively include photoconductors 12Y, 12M, 12C, and 12K, which are an example of image carriers. Around the photoconductors 12Y, 12M, 12C, and 12K, charging devices 14Y, 14M, 14C, and 14K; optical scanning devices 16Y, 16M, 16C, and 16K; developing devices 18Y, 18M, 18C, and 18K; first transfer devices 20Y, 20M, 20C, and 20K; and photoconductor cleaners 22Y, 22M, 22C, and 22K are provided, respectively. Note that reference alphabets Y, M, C, and K are omitted when a description may be given without distinction of individual colors.

The charging device 14 electrically charges the surface of the photoconductor 12. The optical scanning device 16 performs exposure and scanning so as to form an electrostatic latent image on the surface (i.e., a surface to be scanned) of the photoconductor 12 which has been electrically charged in accordance with control of a controller 48 (details thereof will be described later). The developing device 18 develops the electrostatic latent image on the surface of the photoconductor 12, using toner contained in a developer so as to form a toner image. The first transfer device 20 includes, for example, a transfer roller, and performs first transfer in which the toner image is transferred onto a transfer belt 100, which is an example of a transferred-image receiving member. The photoconductor cleaner 22 removes residual toner on the surface of the photoconductor 12 after the transfer.

The transfer belt 100 is rotatably supported by (stretched around) a driving roller 26*a*, a tension steering roller 26*c*, support rollers 26*b*, 26*d*, and 26*e*, and a backup roller 28 with tension being applied to its inner surface. The tension steering roller 26*c* prevents the transfer belt 100 from being distorted or from winding. The driving roller 26*a*, the tension steering roller 26*c*, and the support rollers 26*b*, 26*d*, and 26*e* around which the transfer belt 100 is stretched; and a motor (not illustrated) that causes the driving roller 26*a* to rotate constitute a belt driving device 25.

In the vicinity of the transfer belt 100, a second transfer device 30 is arranged. The second transfer device 30 includes, for example, a transfer roller which opposes the backup roller 28 with the transfer belt 100 interposed therebetween. On the downstream side of the second transfer device 30 in a rotation direction (see an arrow X in FIG. 1) of the transfer belt 100, a belt cleaner 32 is arranged. The belt cleaner 32 removes residual toner on the outer surface of the transfer belt 100.

In the vicinity of the second transfer device 30, a sheet supplying device 33 that transports and supplies paper P, which is an example of a recording medium, to the second transfer device 30; and a fixing device 36 that fixes a transferred toner image on the paper P are provided. Note that the paper P and the transfer belt 100 used in the exemplary embodiment correspond to recoding media.

In the image forming apparatus 10, the photoconductor 12Y rotates clockwise in the drawing and is electrically charged by the charging device 14Y in the image forming unit 11Y. Then, the optical scanning device 16Y performs exposure and scanning, and consequently an electrostatic latent image of a first color (Y) is formed on the surface of the charged photoconductor 12Y.

The electrostatic latent image is developed using toner (or a developer containing toner) supplied by the developing device 18Y, and consequently a visible toner image is formed. The toner image reaches a first transfer portion as the photoconductor 12Y rotates. The first transfer device 20Y applies an electric field of opposite polarity to the toner image so as to perform first transfer in which the toner image is transferred onto the transfer belt 100.

In the same manner, a toner image of a second color (M), a toner image of a third color (C), and a toner image of a fourth color (K) are sequentially formed by the image forming units 11M, 11C, and 11K, respectively, and are superimposed with one another on the transfer belt 100. In this way, a multi-layer toner image is formed.

Then, the transfer belt 100 rotates and the transferred multi-layer toner image on the transfer belt 100 reaches a second transfer portion in which the second transfer device 30 is provided. In the second transfer portion, bias (transfer voltage) of the same polarity as that of the toner image is applied between the transfer belt 100 and the backup roller 28, which is arranged to oppose the second transfer device 30 with the transfer belt 100 interposed therebetween, so as to cause electrostatic repulsion. The toner image is transferred onto the paper P by electrostatic repulsion.

Specifically, the papers P are taken out one by one by a pickup roller (not illustrated) from papers contained in a paper container (not illustrated). Each paper P is supplied to the second transfer portion between the transfer belt 100 and the second transfer device 30 by a feed roller (not illustrated) at a predetermined timing. The second transfer device 30 and the backup roller 28 are pressed against each other and a transfer voltage is applied, and consequently the toner image on the transfer belt 100 is transferred onto the supplied paper P.

The paper P having the toner image transferred thereon is transported to the fixing device 36 by a transportation device 34. The toner image is fixed through pressure/heat application processing, and consequently a permanent image is obtained.

After the multi-layer toner image is transferred onto the paper P, residual toner on the outer surface of the transfer belt 100 is removed for the next transfer by the belt cleaner 32 provided downstream of the second transfer portion. The second transfer device 30 also includes a cleaning member (not illustrated), and foreign objects such as toner particles and paper dust attached through transfer are removed.

In the case of a single-color image, a toner image resulting from first transfer is subjected to second transfer using a single color, and the paper P having the toner image thereon is transported to the fixing device 36. In the case of a multi-color image obtained by superimposition of multiple colors, the transfer belt 100 and the photoconductors 12Y, 12M, 12C, and 12K rotate in synchronization with one another so that toner images of the respective colors are superimposed with one another at the first transfer portions so as to prevent misalignment between the toner images of the respective colors.

In this way, the image forming apparatus 10 according to the first exemplary embodiment forms an image on the paper P.

Now, the configuration of the optical scanning device 16 will be described. The optical scanning devices 16 for the respectively colors according to the first exemplary embodiment have the same configuration.

Figure 2:
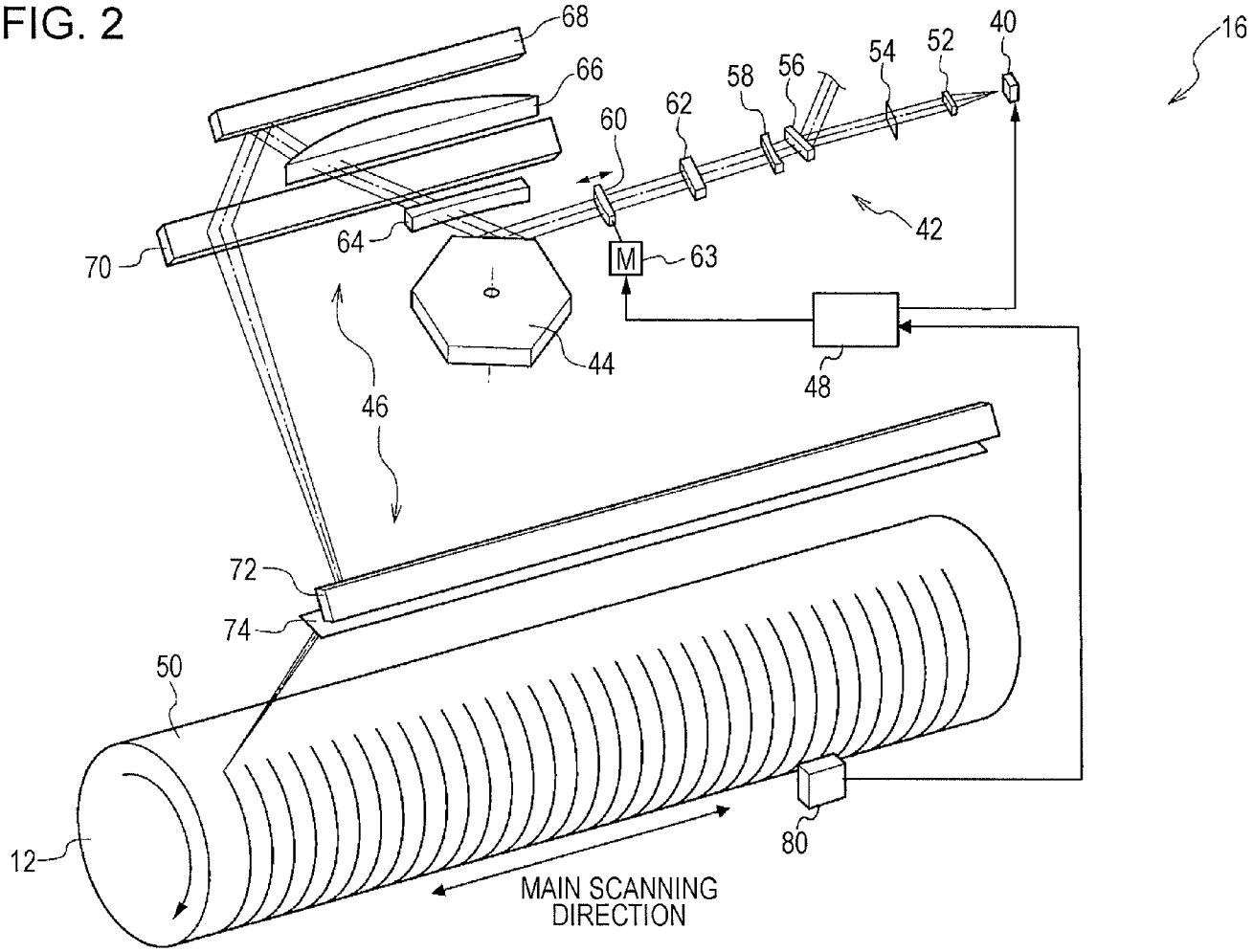
FIG. 2 illustrates a schematic configuration of an example of an optical scanning device according to the first exemplary embodiment.

FIG. 2 illustrates a schematic configuration of an example of the optical scanning device 16 according to the first exemplary embodiment. The optical scanning device 16 includes a light source 40, a pre-deflection optical system 42, a deflector 44, a scanning optical system 46, and the controller 48.

The light source 40 is, for example, a vertical cavity surface emitting laser (VCSEL), and includes multiple light emitting points (not illustrated) two-dimensionally arranged in the main scanning direction and the sub-scanning direction. Specifically, in the case of the light source 40 including 32 light emitting points, four columns are arranged in the main scanning direction, and each column includes eight light emitting points arranged along the sub-scanning direction. In the first exemplary embodiment, the light source 40 is electrically connected to the controller 48, and ON/OFF of multiple light emitting points are controlled independently of one another by the controller 48.

A beam emitted from the light source 40 is led to the deflector 44 through the pre-deflection optical system 42. In the first exemplary embodiment, a polygon mirror is used as an example of the deflector 44 as illustrated in FIG. 2. The beam led to the deflector 44 is deflected to the main scanning direction by the rotating deflector 44. The deflected beam is radiated to a photoconductor surface 50, which is an example of a surface to be scanned, through the scanning optical system 46. That is, a beam emitted from the light source 40 is radiated to the photoconductor surface 50 with being deflected to the main scanning direction by the deflector 44 and the scanning optical system 46. In this way, the photoconductor surface 50 is scanned with and exposed to the beam.

A direction in which a scan is performed while deflecting a beam by the deflector 44 and the scanning optical system 46 is the main scanning direction, and a direction perpendicular to the main scanning direction is the sub-scanning direction. On the photoconductor surface 50, a direction corresponding to an axis direction is the main scanning direction, and a direction corresponding to a rotation direction is the sub-scanning direction. Also, a direction in which the beam propagates and which is perpendicular to the main scanning direction and the sub-scanning direction is an optical axis direction.

The pre-deflection optical system 42 includes a collimator lens 52, a slit 54, a beam splitter 56, a pair of expander lenses 58 and 60, and a cylindrical lens 62. The collimator lens 52 converts a beam emitted from the light source 40 into a beam of parallel rays. The slit 54 blocks part of the beam that has passed through the collimator lens 52 so as to shape the beam into a desired shape. The beam splitter 56 splits the beam that has passed through the slit 54 into transmitting light for image writing and reflected light for light amount adjustment. The pair of expander lenses 58 and 60 increase the main-scanning-direction beam diameter of the transmitting light that has passed through the beam splitter 56. The cylindrical lens 62 is provided between the pair of expander lenses 58 and 60, and causes the beam to converge in the sub-scanning direction.

Among the pair of expander lenses 58 and 60, the expander lens 58 located upstream in a beam propagating direction is a lens has a power only for the main scanning direction, and converts the parallel rays into divergent rays only in the main scanning direction. In contrast, the expander lens 60 located downstream in the beam propagating direction is a lens having a power only for the main scanning direction, and re-converts the resulting divergent rays obtained by the expander lens 58 into parallel rays. In this way, the beam diameter is increased by the pair of expander lenses 58 and 60.

As illustrated in FIG. 2, the expander lens 60 located downstream in the beam propagating direction is connected to a stepping motor 63. The expander lens 60 is configured to be movable in the optical axis direction (details thereof will be described later). The expander lens 60 is driven by the stepping motor 63 to move and adjust a focal position (focusing state) of the beam on the photoconductor surface 50. The stepping motor 63 is electrically connected to the controller 48. The controller 48 has a function for controlling movement of the expander lens 60 via the stepping motor 63 (details thereof will be described later). The controller 48 according to the first exemplary embodiment grasps a movement distance of the expander lens 60 from a driving amount (number of pulses) of the stepping motor 63.

The cylindrical lens 62 is a lens having a power only for the sub-scanning direction, and causes a beam to converge in the vicinity of the deflector 44 in the sub-scanning direction.

The scanning optical system 46 includes, sequentially from the upstream, an fθ lens 64, an fθ lens 66, a cylindrical mirror 68, a folding mirror 70, a cylindrical mirror 72, and a window glass 74.

The two fθ lenses 64 and 66 convert the position scanned with the beam so that the photoconductor surface 50 is scanned with the beam at a uniform speed, and cause the main-scanning-direction beam diameter to converge. The two cylindrical mirrors 68 and 72 are mirrors having powers only for the sub-scanning direction. The two cylindrical mirrors 68 and 72 form an afocal optical system, and cause the sub-scanning-direction beam diameter to converge. Also, the two cylindrical mirrors 68 and 72 have a function for correcting tilt (face tangle) of the deflector 44 in the sub-scanning direction. The folding mirror 70 folds the beam between the two cylindrical mirrors 68 and 72. The window glass 74 is a window from which the beam is emitted and prevents entry of dust or foreign objects to the optical scanning device 16.

In the first exemplary embodiment, a surface potential sensor 80 for detecting a potential on the photoconductor surface 50 is provided in the vicinity of the photoconductor 12. The surface potential sensor 80 is, for example, an electrostatic voltmeter (ESV) sensor. Note that the surface potential sensor 80 is not limited to an ESV sensor as long as it has a function for detecting a potential on the photoconductor surface 50. In the first exemplary embodiment, a potential of an electrostatic latent image is detected by detecting a surface potential on the photoconductor surface 50.

The surface potential sensor 80 according to the first exemplary embodiment is electrically connected to the controller 48. The surface potential sensor 80 detects the surface potential in a predetermined detection area of the photoconductor surface 50, and outputs the obtained surface potential to the controller 48.

Now, a process (hereinafter, referred to as a "focusing state adjustment process") for adjusting a focusing state of a beam radiated from the optical scanning device 16 on the photoconductor surface 50, which is executed by the controller 48 according to the first exemplary embodiment will be described. The controller 48 is implemented by a computer or an application-specific integrated circuit (ASIC) including a central processing unit (CPU), a random access memory (RAM), and a read only memory (ROM). The CPU executes a program stored in the ROM, whereby the focusing state adjustment process is executed.

First, the principle of the focusing state adjustment process according to the first exemplary embodiment will be described.

Figure 3:
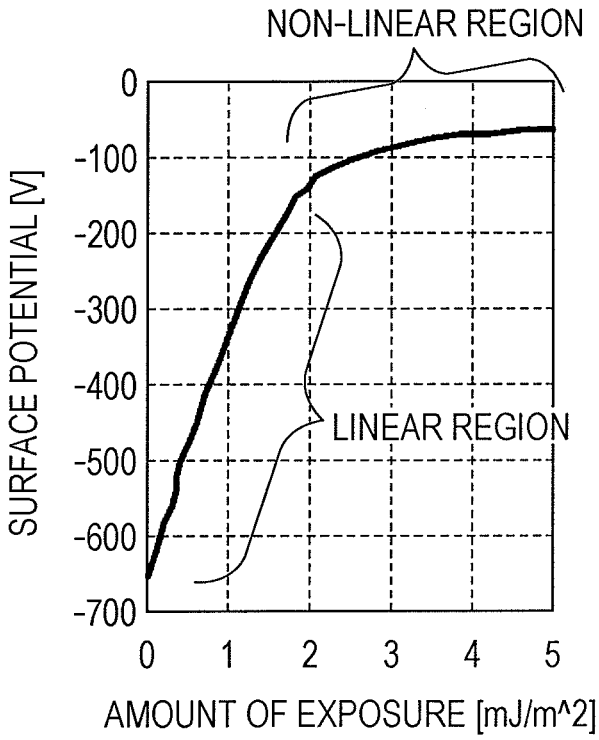
FIG. 3 is a graph illustrating a discharge curve which represents an example of a correspondence between an amount of exposure and a surface potential on a photoconductor surface in accordance with the first exemplary embodiment.

FIG. 3 is a graph illustrating a photo-induced discharge curve (PIDC) which represents an example of a correspondence between an amount of exposure and a surface potential on the photoconductor surface 50. As illustrated in FIG. 3, the correspondence between the amount of exposure and the surface potential includes a linear region and a non-linear region. In the non-linear region, if the amount of exposure increases, the surface potential does not increase as much as that of the linear region.

Figure 4:
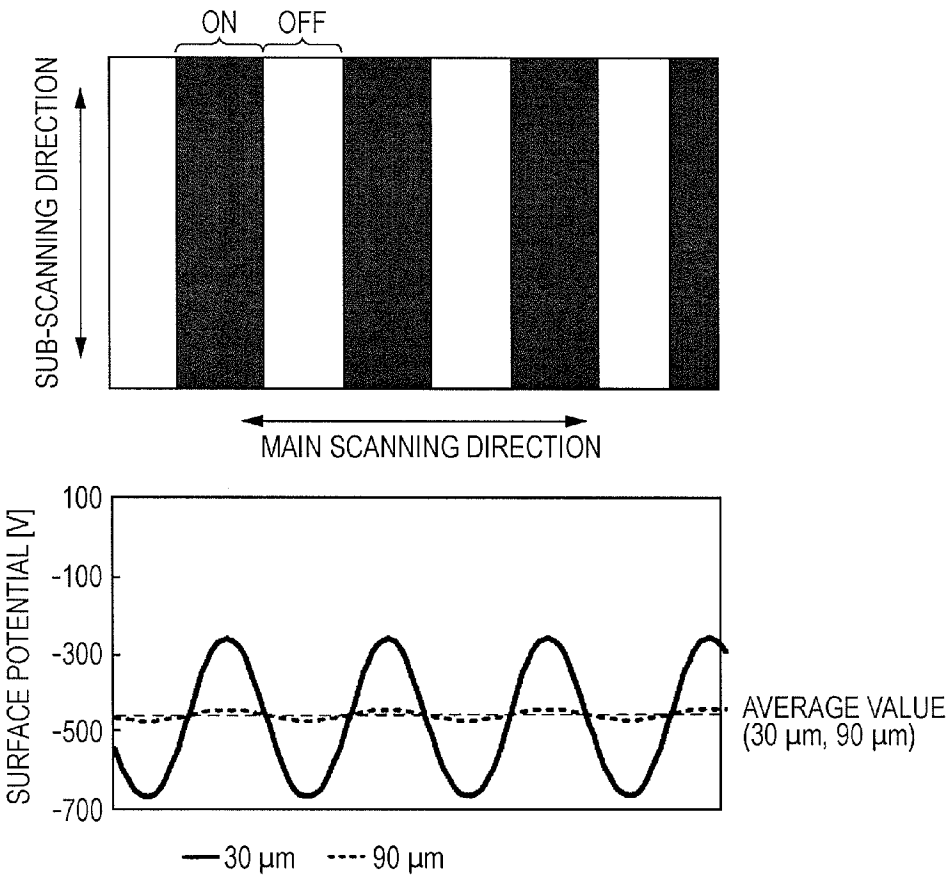
FIG. 4 illustrates an example of a profile of the surface potential on the photoconductor surface of the image forming apparatus according to the first exemplary embodiment in a linear region.
Figure 5:
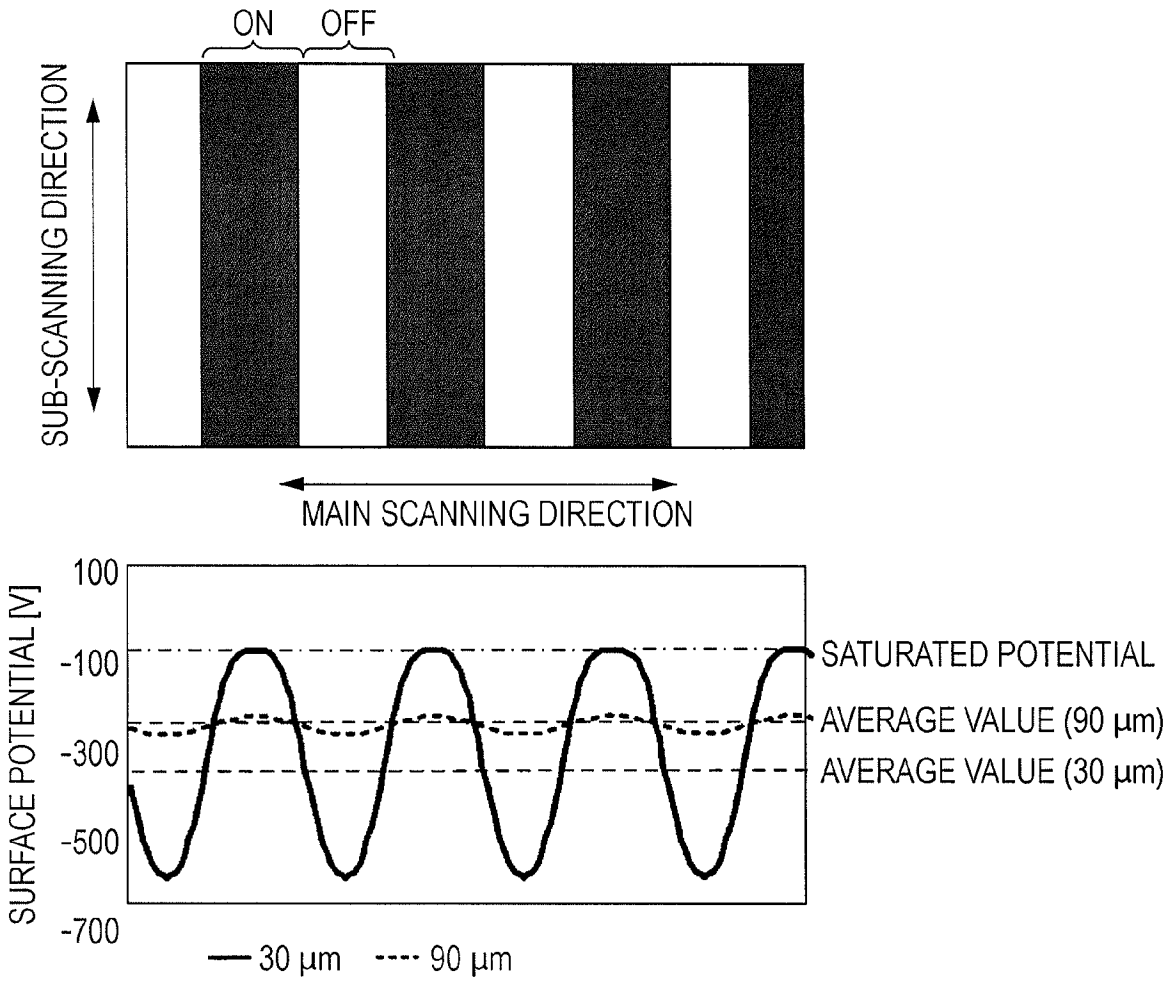
FIG. 5 illustrates an example of a profile of the surface potential on the photoconductor surface of the image forming apparatus according to the first exemplary embodiment in a non-linear region.

FIGS. 4 and 5 each illustrate a profile on the photoconductor surface 50 obtained when an electrostatic latent image of a ladder pattern, which is composed of lines extending in the sub-scanning direction, is formed as an image used for focusing state adjustment. Specifically, FIGS. 4 and 5 each illustrate the surface potential on the photoconductor surface 50 in the main scanning direction obtained when the beam diameter (corresponding to ON of the light source 40) is 30 μm and 90 μm. FIG. 4 illustrates an example of a profile of the surface potential on the photoconductor surface 50 in the linear region. FIG. 5 illustrates an example of a profile of the surface potential on the photoconductor surface 50 in the non-linear region.

As illustrated in FIG. 4, as the beam diameter increases, the peak of the surface potential lowers, and consequently a dull curve with a wide base is obtained. Also, as illustrated in FIG. 4, there is no difference between the average surface potential for the beam diameter of 30 μm and that for the beam diameter of 90 μm in the linear region. Even if there is a difference, the difference is allowable as experimentally obtained errors. As described above, in the linear region, even if the in-focus position is shifted and the beam diameter is changed (to be larger), the average surface potential hardly changes.

In contrast, as illustrated in FIG. 5, the peak surface potential does not reach a saturated level in the case of the beam diameter of 90 μm. In the case of the beam diameter of 30 μm, the peak surface potential reaches the saturated potential, and a profile with a flatted convex is obtained. Accordingly, compared with the average surface potential for the beam diameter of 90 μm, the average surface potential for the beam diameter of 30 μm lowers. As described above, in the non-linear region, when the focusing position is shifted and the beam diameter is changed (to be larger), the average surface potential rises.

That is, in the non-linear region of the discharge curve, the average surface potential obtained in the focusing (in-focus) state is lower than the average surface potential obtained in the out-of-focus state.

Figure 6:
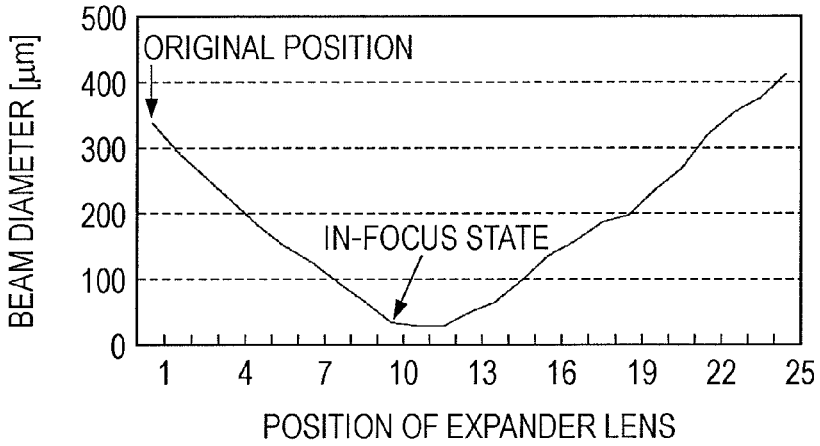
FIG. 6 is a graph representing an example of a correspondence between the position of an expander lens and the beam diameter in the image forming apparatus according to the first exemplary embodiment.
Figure 7:
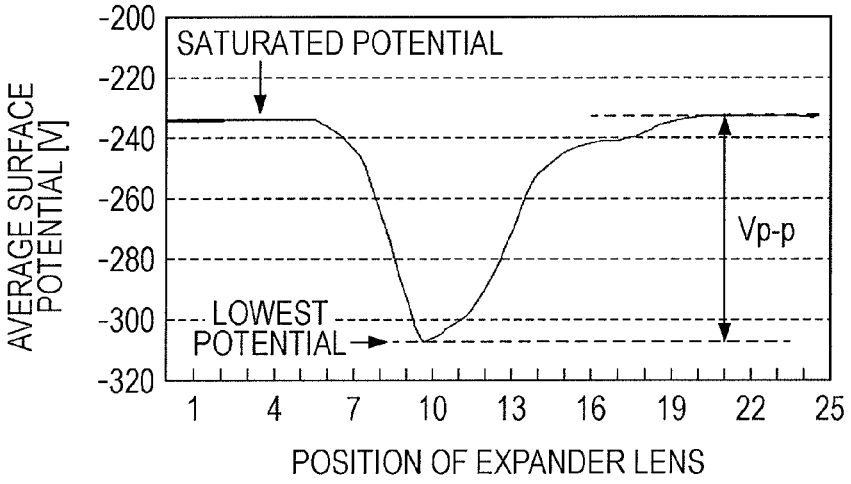
FIG. 7 is a graph representing an example of a correspondence between the position of the expander lens and the average surface potential on the photoconductor surface in the image forming apparatus according to the first exemplary embodiment.

In order to utilize the phenomenon that occurs in the non-linear region, the focusing state is adjusted by forming an electrostatic latent image at an amount of exposure which corresponds to the non-linear region of the discharge curve in the first exemplary embodiment. Specifically, in the first exemplary embodiment, in order to adjust the focusing state, for example, the expander lens 60 of the optical scanning device 16 is moved using the stepping motor 63 as described above. FIG. 6 illustrates a graph representing an example of a correspondence between the position of the expander lens 60 and the beam diameter. Also, FIG. 7 illustrates a graph representing an example of a correspondence between the position of the expander lens 60 and the average surface potential on the photoconductor surface 50. Note that in the cases of FIGS. 6 and 7, an electrostatic latent image is formed at an amount of exposure which corresponds to the non-linear region of the discharge curve.

Referring to FIGS. 6 and 7, a position to which the expander lens 60 is moved from its original position is illustrated as the "position of the expander lens". The original position is an initial position, and is, for example, a position closest to the cylindrical lens 62 within a movable range of the expander lens 60. In this case, the position of the expander lens corresponds to the position at which the expander lens 60 that has been moved from the original position in a direction closer to the deflector 44 is located, that is, a distance from the original position.

The beam diameter rarely varies in the in-focus state, compared with the out-of-focus state. Accordingly, in the first exemplary embodiment, a state in which the beam diameter becomes minimum is considered as an in-focus state.

As illustrated in FIG. 7, on a side where the position of the expander lens 60 is close to the original position or on a side where the position of the expander lens 60 is away from the original position (close to the deflector 44), the surface potential is saturated. That is, when the out-of-focus state occurs and the beam diameter becomes larger, the surface potential increases and eventually is saturated. In contrast, in the in-focus state, the surface potential becomes minimum as illustrated in FIGS. 6 and 7. Therefore, in the first exemplary embodiment, the state in which the surface potential on the photoconductor surface 50 becomes minimum is considered as the in-focus state.

Figure 8:
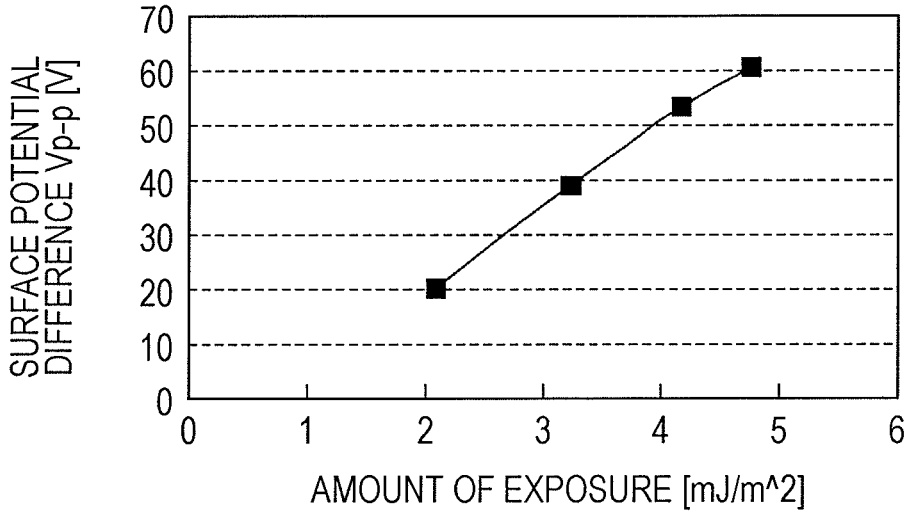
FIG. 8 is a graph representing an example of a correspondence between a surface potential difference Vp-p and an amount of exposure on the photoconductor of the image forming apparatus according to the first exemplary embodiment.

In order to consider a state in which the surface potential becomes minimum as the in-focus state, a surface potential difference Vp-p which is a potential difference between a saturated potential and the minimum potential needs to take a significant value with consideration of errors, such as detection errors. FIG. 8 illustrates a graph representing an example of a correspondence between the surface potential difference Vp-p and the amount of exposure. In the case where the correspondence illustrated in FIG. 8 is obtained, a significant surface potential difference Vp-p is obtained in a range of the amount of exposure illustrated in FIG. 8 (the amount of exposure which corresponds to the non-linear region). Thus, an amount of exposure within the range may be set as an amount of light for adjustment. The amount of light for adjustment may be obtained from experiments or the like in advance. Note that the amount of light for adjustment corresponds to intensity for adjustment.

Accordingly, in the focusing state adjustment process according to the first exemplary embodiment, an electrostatic latent image is formed on the photoconductor surface 50 at the amount of light for adjustment, which is an amount of exposure at which the discharge curve is non-linear, and the optical scanning device 16 is controlled (the expander lens 60 is moved) so that the potential of the electrostatic latent image (on the photoconductor surface 50) becomes minimum. In this way, the focusing state is adjusted.

Figure 9:
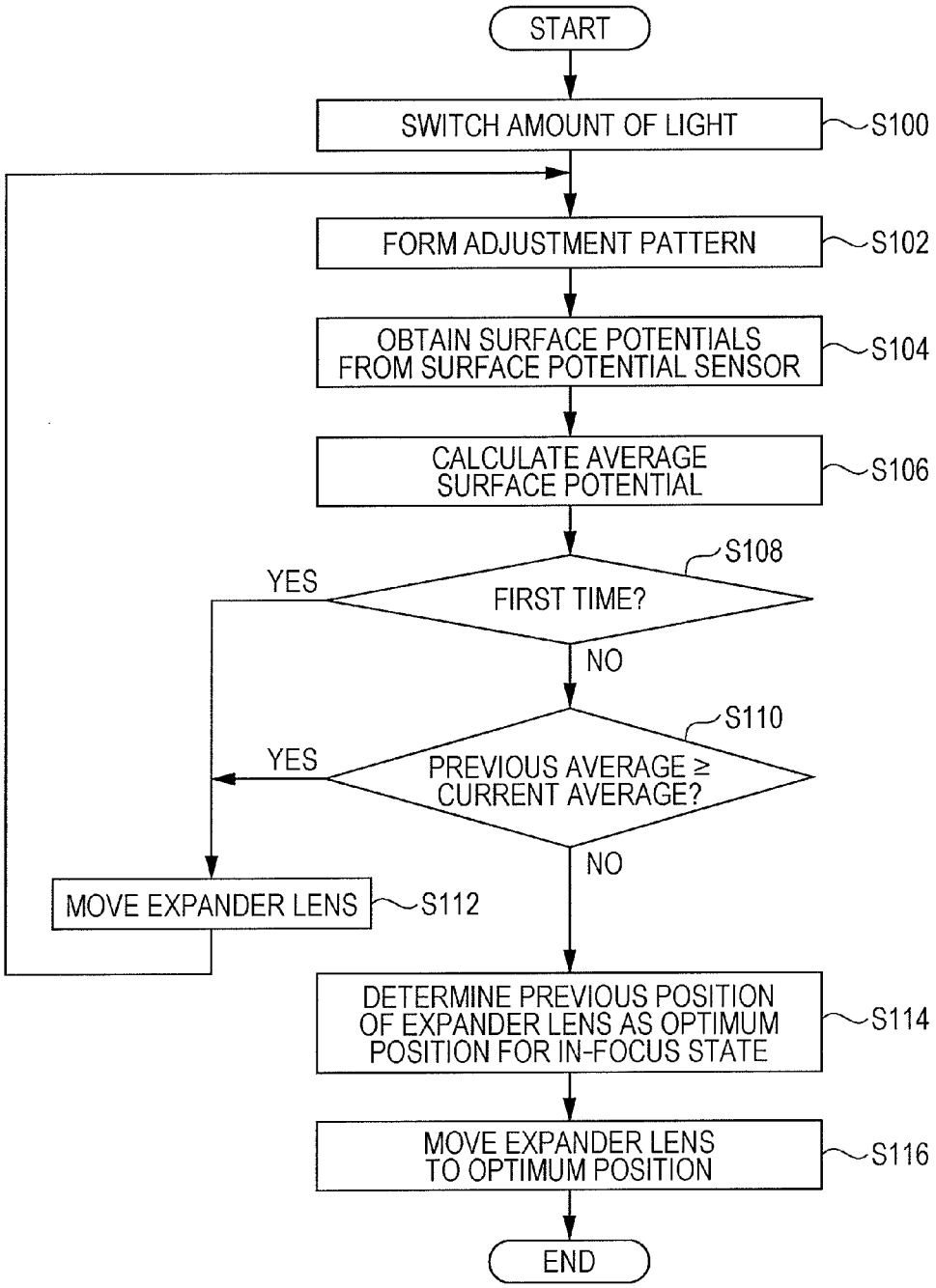
FIG. 9 is a flowchart of an example of the flow of a focusing state adjustment process executed by a controller in accordance with the first exemplary embodiment.

FIG. 9 illustrates a flowchart of an example of the flow of the focusing state adjustment process executed by the controller 48 in accordance with the first exemplary embodiment. Note that a timing at which the focusing state adjustment process is executed may be, but not limited to, a timing of power-on of the image forming apparatus 10, a timing before or after formation of images based on a series of image data, a timing after formation of a predetermined number of images, or a timing desired by the user.

In step S100, the amount of exposure is switched to the amount of light for adjustment. In the case where an image is formed on a recording medium, the image forming apparatus 10 according to the first exemplary embodiment usually performs exposure on the photoconductor surface 50 at an amount of exposure (amount of normal exposure) within a range corresponding to the linear region of the discharge curve described above. In contrast, the amount of light for adjustment is an amount of exposure within a range corresponding to the non-linear region of the discharge curve, and is larger than the amount of normal exposure.

Accordingly, the controller 48 controls the light source 40 so as to switch the amount of exposure to the amount of light for adjustment.

The light source 40 used in the first exemplary embodiment includes a driving unit (not illustrated) for turning ON/OFF and driving the light emitting points. The driving unit generates a driving current, and supplies the driving current to the light emitting points. Based on control of the controller 48, the driving unit generates a driving current of a magnitude corresponding to the amount of light for adjustment, and supplies the driving current to the light emitting points. The driving unit of the light source 40 used in the first exemplary embodiment switches the amount of exposure to the amount of light for adjustment by changing the magnitude of the driving current; however, the switching method is not limited to this one. For example, a driving pulse duration may be changed in the case where driving is performed using a pulse signal. Alternatively, for example, a voltage for the driving current may be changed.

Subsequently, in step S102, the adjustment pattern is formed on the photoconductor surface 50. In the first exemplary embodiment, a ladder pattern (see FIGS. 4 and 5) composed of lines extending in the sub-scanning direction is used as the adjustment pattern used to adjust the focusing state in the main scanning direction. Therefore, image data of the ladder pattern is pre-stored in a memory (not illustrated) included in the controller 48. Based on the image data of the ladder pattern, the controller 48 controls the light source 40 so as to turn ON/OFF the light emitting points. In this way, an electrostatic latent image of the ladder pattern is formed on the photoconductor surface 50 (see the photoconductor 12 in FIG. 1).

Subsequently, in step S104, the controller 48 obtains surface potentials from the surface potential sensor 80. The surface potential sensor 80 used in the first exemplary embodiment detects surface potentials in a predetermined detection area of the photoconductor surface 50, and outputs the obtained surface potentials to the controller 48.

Subsequently, in step S106, the controller 48 calculates an average of the surface potentials. In the first exemplary embodiment, plural surface potentials (at plural positions) within the detection area are obtained. Thus, the controller 48 calculates the average of the obtained surface potentials. In the first exemplary embodiment, the calculated average is temporarily stored in a storage (not illustrated) such as a memory included in the controller 48. Note that calculation of the average may be omitted; however, the precision of adjustment improves by calculating the average for multiple detection areas or for a larger detection area.

Subsequently, in step S108, the controller 48 determines whether or not this is the first time the average has been calculated. Specifically, the controller 48 determines whether steps S102 to S106 have been performed for the first time during the focusing state adjustment process. If it is determined that this is the first time (YES), the process proceeds to step S112. If it is determined that this is not the first time, i.e., this is the second or subsequent time (NO), the process proceeds to step S110.

In step S110, the controller 48 determines whether or not "the previous average≥the current average" is satisfied. If the current average is smaller than or equal to the previous average (YES), the process proceeds to step S112.

In step S112, the controller 48 moves the expander lens 60. Specifically, the controller 48 controls the stepping motor 63 to move the expander lens 60. A movement distance of the expander lens 60 during one adjustment procedure may be, but not limited to, experimentally determined in advance based on a correspondence between the surface potential on the photoconductor surface 50 and the position of the expander lens 60 or the like.

During the focusing state adjustment process according to the first exemplary embodiment, the focusing state is repeatedly adjusted by detecting surface potentials with the surface potential sensor 80 and moving the expander lens 60 (steps S102 to S112). The movement distance of the expander lens 60 may be set to be the same or different in every adjustment procedure.

Figure 10A:
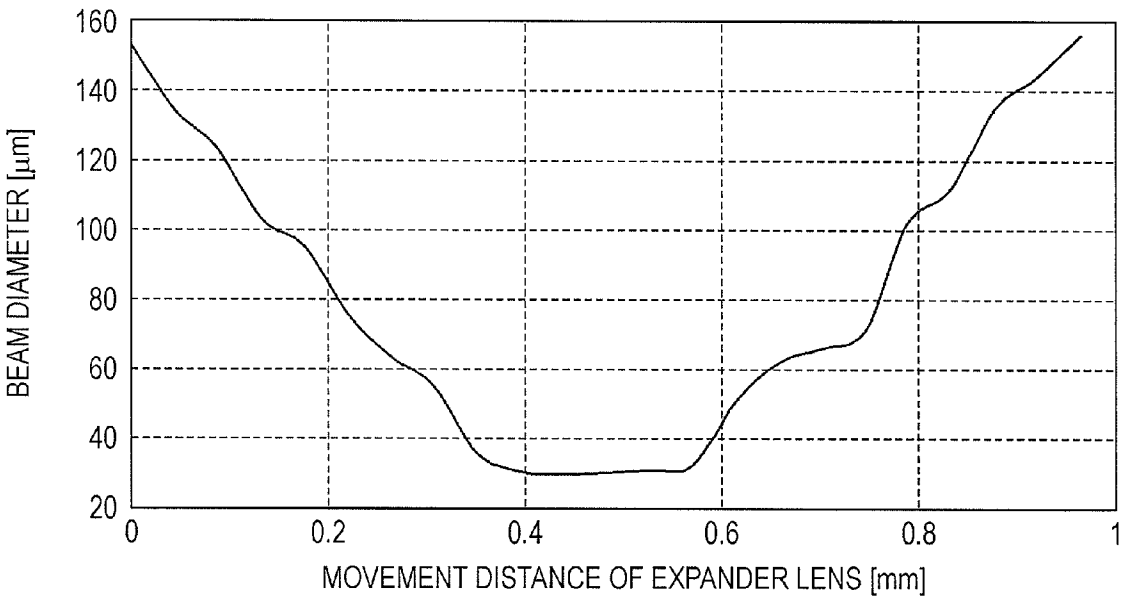
FIGS. 10A and 10B describe an example of movement of the expander lens in the image forming apparatus according to the first exemplary embodiment.
Figure 10B:
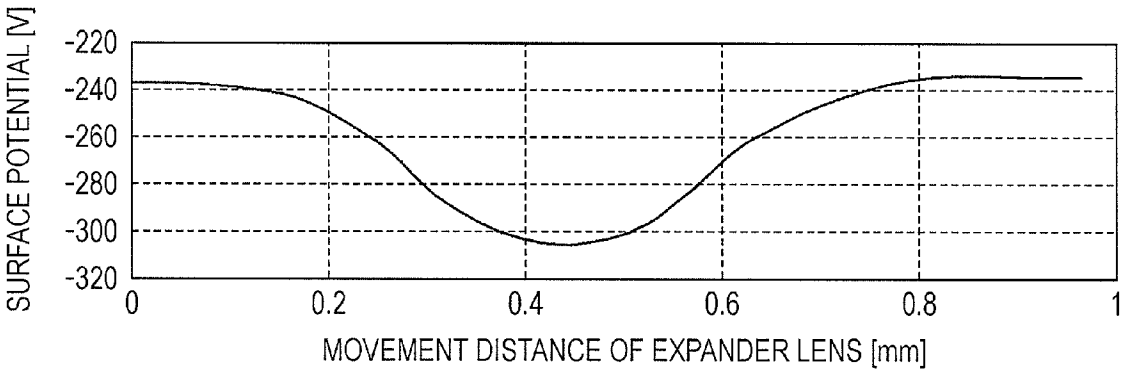

FIGS. 10A and 10B describe an example of movement of the expander lens 60 in the image forming apparatus 10 according to the first exemplary embodiment. FIG. 10A illustrates a graph representing a correspondence between the movement distance of the expander lens 60 and the beam diameter. FIG. 10B illustrates a graph representing a correspondence between the movement distance of the expander lens 60 and the surface potential on the photoconductor surface 50. FIGS. 10A and 10B indicate that the position at which the beam diameter becomes minimum corresponds to the position at which the surface potential becomes minimum. In the first exemplary embodiment, the expander lens 60 is moved in order to detect the position at which the surface potential becomes minimum. In such a case, a large movement distance for one adjustment procedure may be set at an initial period from when movement of the expander lens 60 from the original position is started. When the current average surface potential becomes smaller than the previous average, or when the current average surface potential becomes smaller than the previous average by a predetermined amount or larger, the movement distance for one adjustment procedure may be made smaller. By changing the movement distance in this manner, the time taken for adjustment may be shortened without decreasing the precision of adjustment.

After the expander lens 60 is moved in step S112 in this way, the process returns to step S102 and steps of the process are repeated. As a result of movement of the expander lens 60, the focusing state changes and the beam diameter on the photoconductor surface 50 changes. Thus, processing for forming an electrostatic latent image on the photoconductor surface 50 using the resulting beam diameter, and detecting surface potentials is repeated.

If it is determined in step S110 that the current average surface potential is higher than the previous average surface potential (NO), the process proceeds to step S114.

In step S114, the controller 48 determines that the previous position of the expander lens 60 is the optimum position at which the beam is focused on the photoconductor surface 50.

Subsequently, in step S116, the controller 48 moves the expander lens 60 to the position that has been determined to be the optimum position in step S114, and then terminates the focusing state adjustment process.

The image forming apparatus 10 according to the first exemplary embodiment includes the image forming units 11 (11Y, 11M, 11C, and 11K) of four colors. Thus, for each color, the above-described focusing state adjustment process is desirably performed by forming the adjustment pattern.

As described above, in the first exemplary embodiment, the expander lens 60 is moved, and when the surface potential on the photoconductor surface 50 becomes minimum, it is estimated that the beam is focused. Specifically, in the first exemplary embodiment, after switching the amount of exposure to the amount of light for adjustment, the controller 48 causes an electrostatic latent image of the adjustment pattern to be formed on the photoconductor surface 50. The controller 48 then obtains surface potentials on the photoconductor surface 50 from the surface potential sensor 80, calculates the average of the surface potentials, and moves the expander lens 60. The controller 48 repeatedly forms the adjustment pattern, obtains surface potentials, and moves the expander lens 60; and determines the position of the expander lens 60 at which the average surface potential becomes minimum as an optimum position, and moves the expander lens 60 to the optimum position.

Also, in the first exemplary embodiment, the focusing state is adjusted on the basis of surface potentials detected by the surface potential sensor 80, without measuring line widths of the adjustment pattern. The surface potential sensor 80 is often included in general image forming apparatuses. Accordingly, the first exemplary embodiment enables, with a simple configuration, adjustment of the focusing state of the beam concentrated onto the photoconductor surface 50 by the optical scanning device 16.

Also, in the image forming apparatus 10 according to the first exemplary embodiment, the focal position (focusing state) of the beam is adjusted onto the photoconductor surface 50, and thus a high-precision image is formed.

Second Exemplary Embodiment

The image forming apparatus 10, the optical scanning device 16, and the controller 48 according to a second exemplary embodiment include configurations and operations (processes) similar to the configurations and operations (processes) according to the first exemplary embodiment. Thus, this point is simply mentioned here and detailed descriptions of the similar configurations and operations (processes) are omitted.

In the first exemplary embodiment, a state in which the surface potential on the photoconductor surface 50 becomes minimum is considered as the in-focus state. In contrast, in the second exemplary embodiment, a state in which a density (density value) of a toner image becomes minimum is considered as the in-focus state. As for the image forming apparatus 10 according to the second exemplary embodiment, there are three kinds of toner images, which are a toner image formed on the photoconductor surface 50, a toner image on the transfer belt 100 resulting from first transfer, and a toner image on the paper P resulting from second transfer. The image forming apparatus 10 according to the second exemplary embodiment considers a state in which a density of any of the three kinds of toner images becomes minimum as the in-focus state.

Figure 11A:
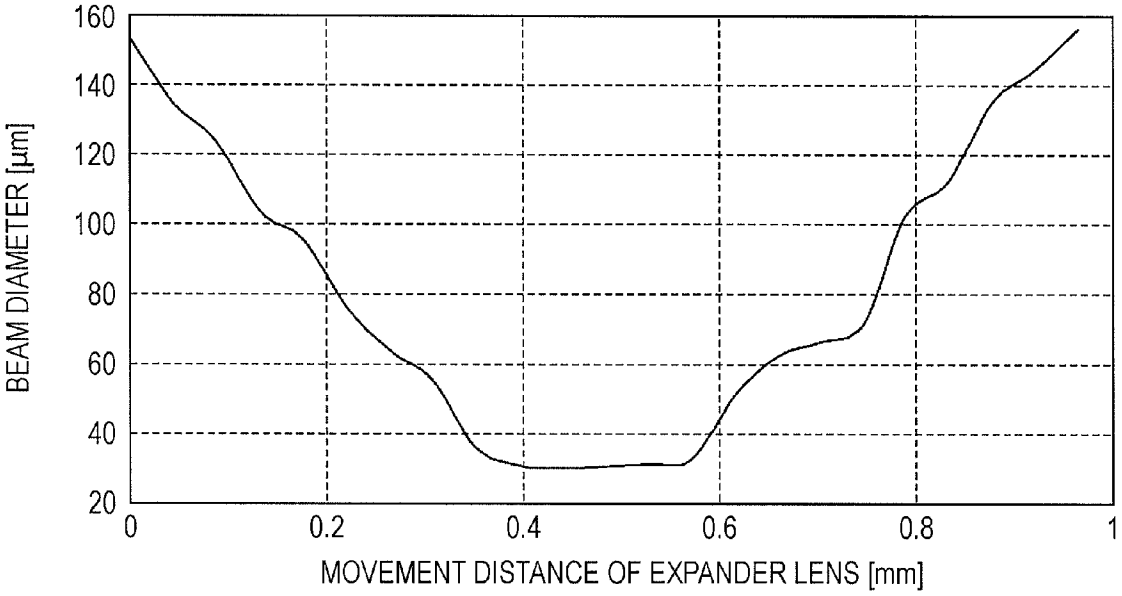
FIGS. 11A and 11B describe an example of movement of the expander lens in an image forming apparatus according to a second exemplary embodiment.
Figure 11B:
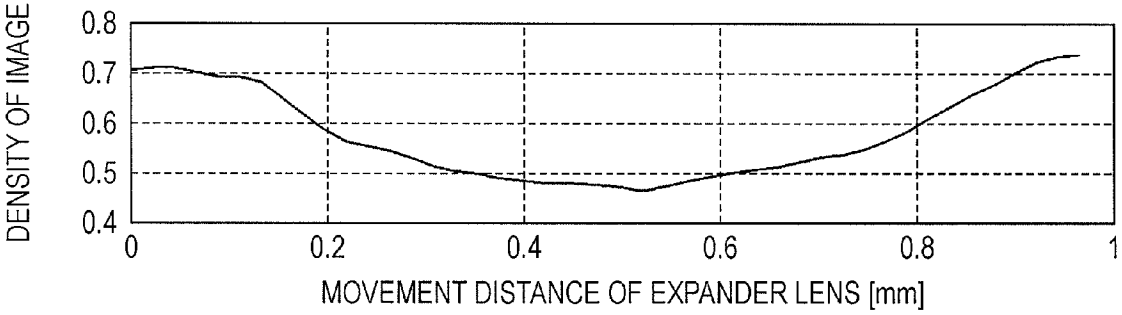

FIGS. 11A and 11B describe an example of movement of the expander lens 60 in the image forming apparatus 10 according to the second exemplary embodiment. FIG. 11A illustrates a graph representing a correspondence between a movement distance of the expander lens 60 and the beam diameter. FIG. 11B illustrates a graph representing a correspondence between the movement distance of the expander lens 60 and a density of a toner image. Note that the density of the toner image illustrated in FIG. 11B is a density of a toner image formed on the paper P. FIGS. 11A and 11B indicate that the position at which the beam diameter becomes minimum corresponds to the position at which the density of the toner image becomes minimum. In the second exemplary embodiment, the position at which the density of the toner image becomes minimum is considered as a position at which the in-focus state is achieved. In order detect this position, the expander lens 60 is moved.

Figure 12:
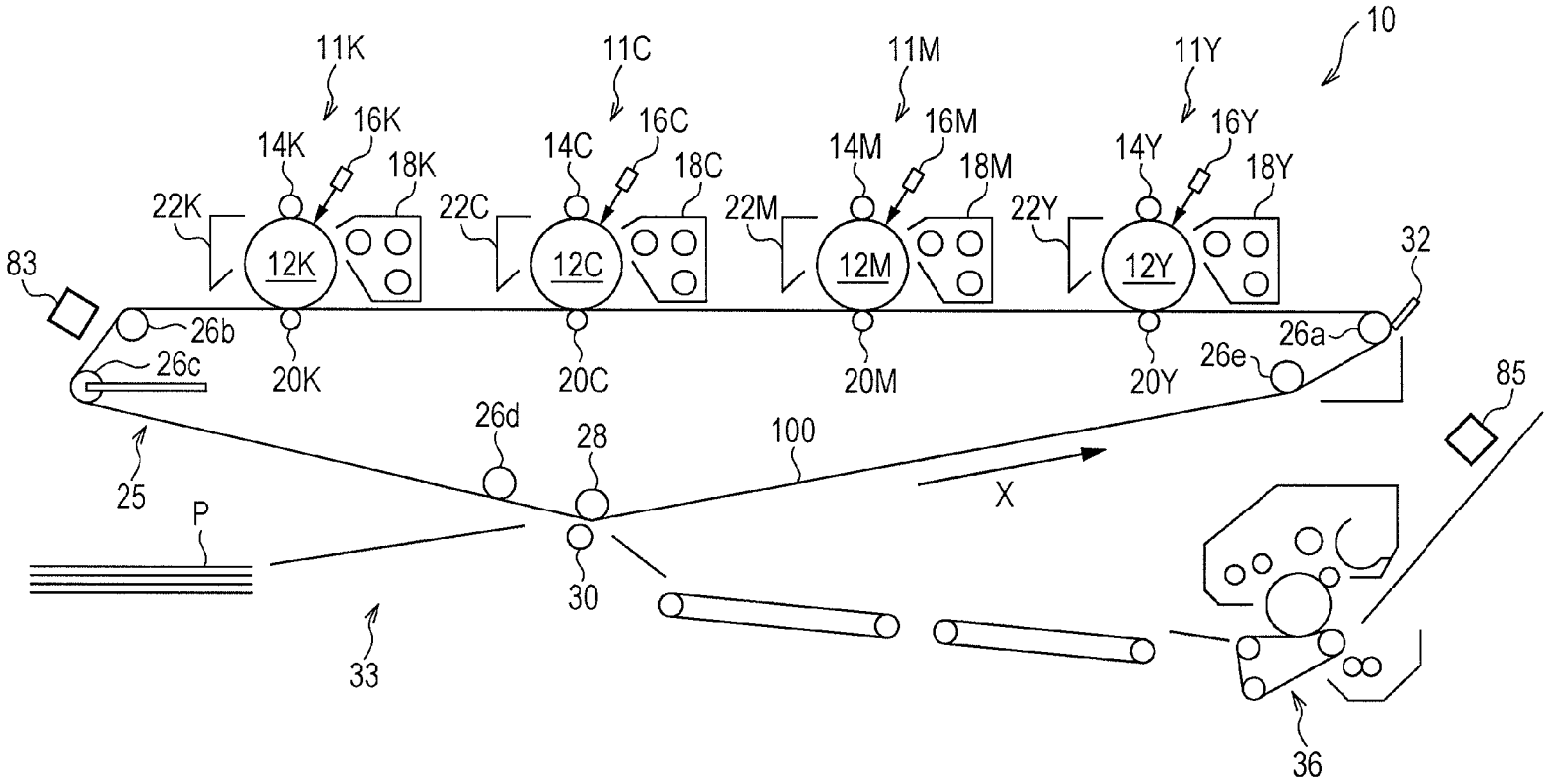
FIG. 12 illustrates a schematic configuration of an example of the image forming apparatus according to the second exemplary embodiment.
Figure 13:
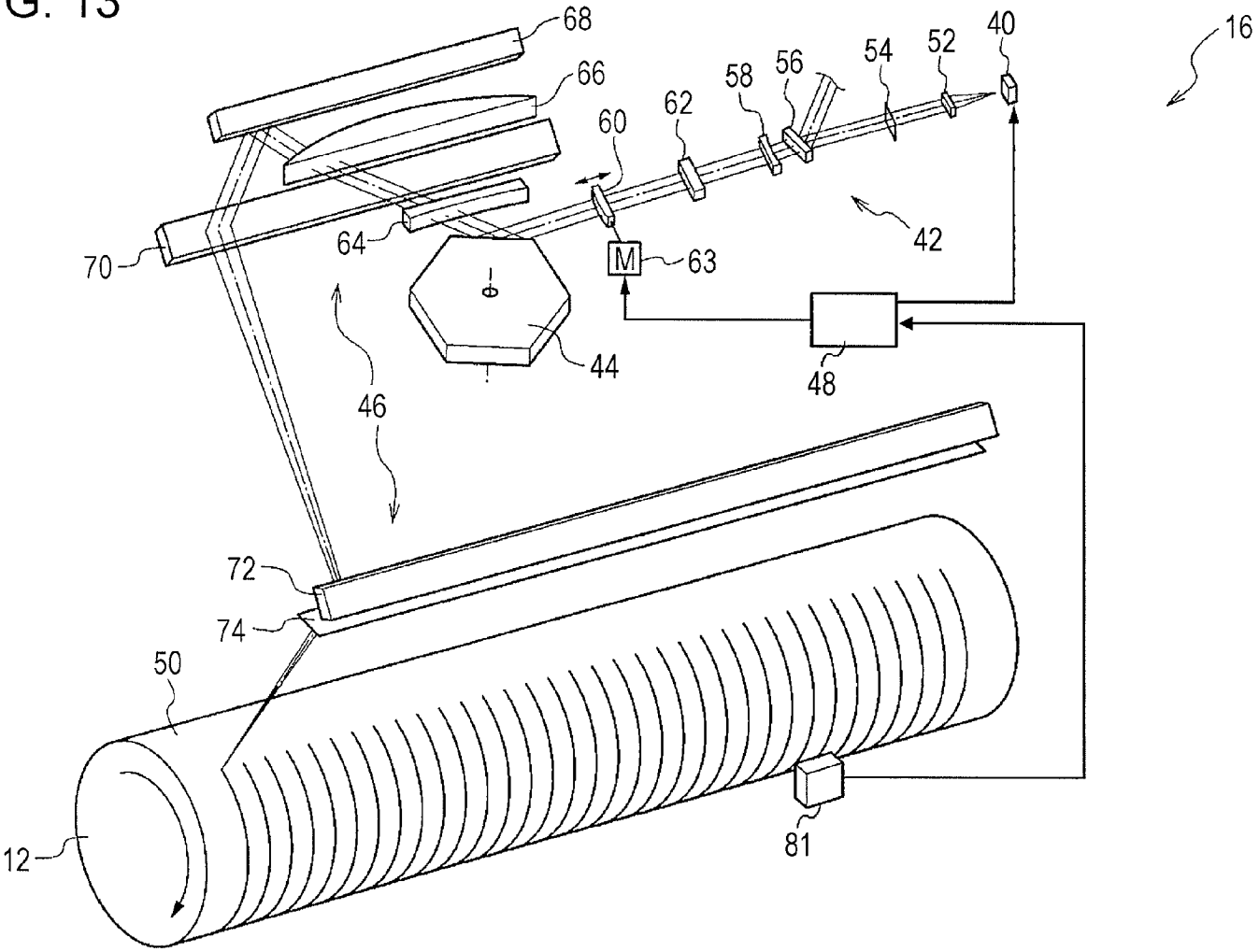
FIG. 13 illustrates a schematic configuration of an example of an optical scanning device according to the second exemplary embodiment.

FIG. 12 illustrates a schematic diagram of an example of the image forming apparatus 10 including a control device according to the second exemplary embodiment. FIG. 13 illustrates a schematic configuration of an example of the optical scanning device 16 according to the second exemplary embodiment.

The image forming apparatus 10 according to the second exemplary embodiment includes density sensors each for detecting a density of a toner image.

In the case where a density of a toner image on the transfer belt 100 resulting from first transfer is detected, a density sensor 83 is provided at a position at which the density sensor 83 opposes a surface of the transfer belt 100 having the toner image transferred thereon and which is located downstream of the image forming unit 11K, which is located most downstream among the image forming units 11. A density value obtained by the density sensor 83 is output to the controller 48.

In the case where a density of a toner image on the paper P resulting from second transfer is detected, a density sensor 85 is provided at a position at which the density sensor 85 opposes a surface of the paper P having the toner image fixed thereon by the fixing device 36. A density value obtained by the density sensor 85 is output to the controller 48.

In the case where a density of a toner image formed on the photoconductor surface 50 is detected, a density sensor 81 is provided at a position at which the density sensor 81 opposes the photoconductor surface 50. A density value obtained by the density sensor 81 is output to the controller 48.

The density sensors 81, 83, and 85 are not limited to sensors of a specific type as long as they are capable of detecting a density of a toner image. FIG. 12 illustrates both the density sensors 83 and 85; however, the image forming apparatus 10 according to the second exemplary embodiment may include at least one of the density sensors 81, 83, and 85 because the density based on which the focusing state is to be adjusted is determined in advance.

Figure 14:
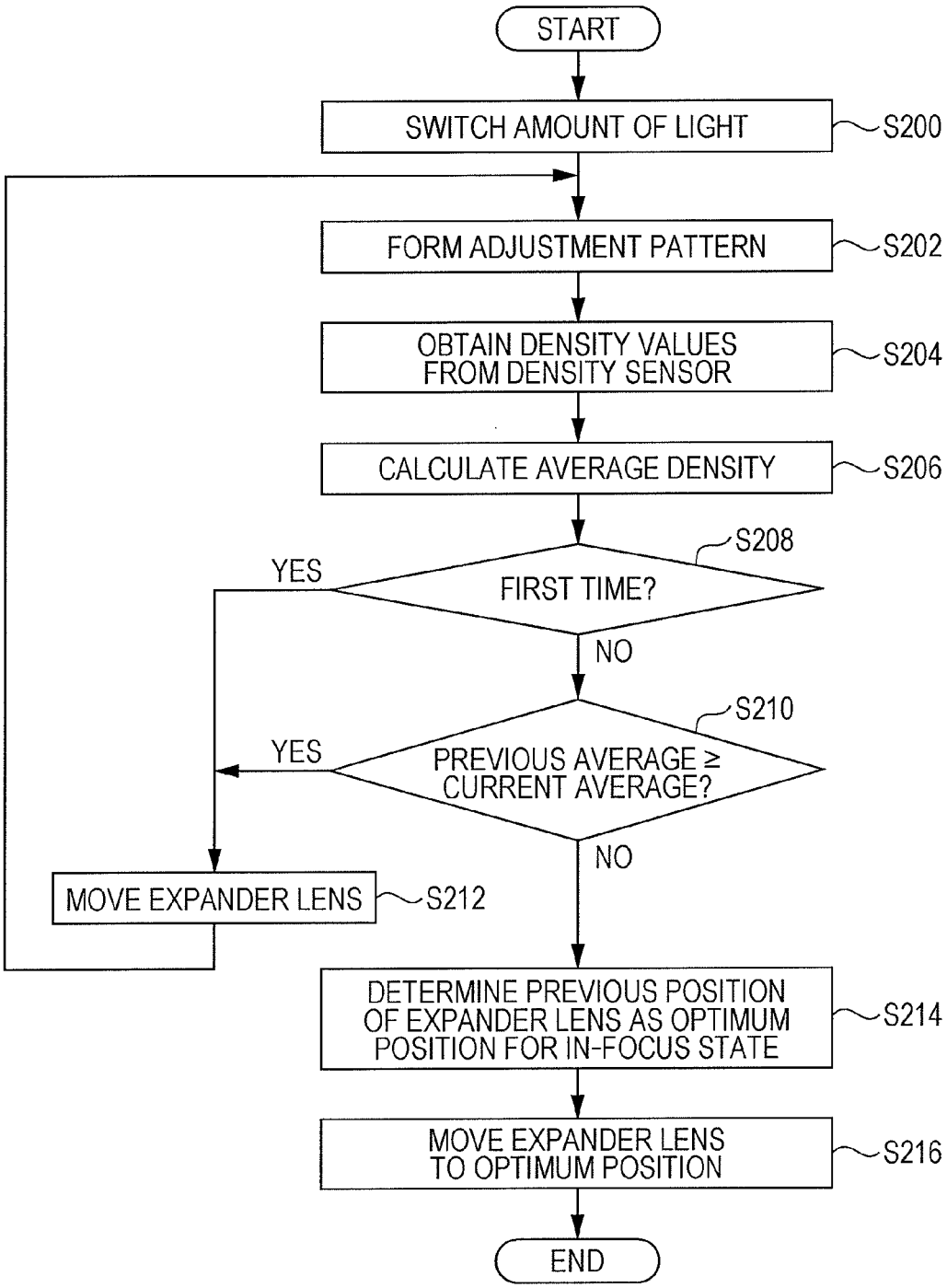
FIG. 14 is a flowchart of an example of the flow of a focusing state adjustment process executed by the controller in accordance with the second exemplary embodiment.

A focusing state adjustment process according to the second exemplary embodiment will be described. FIG. 14 illustrates a flowchart of an example of the flow of the focusing state adjustment process executed by the controller 48 in accordance with the second exemplary embodiment. The focusing state adjustment process according to the second exemplary embodiment includes processing steps similar to those of the focusing state adjustment process (see FIG. 9) according to the first exemplary embodiment. Thus, this point is simply mentioned here and a detailed description of the similar processing steps is omitted.

Steps S200 and S202 respectively correspond to steps S100 and S102 of the focusing state adjustment process according to the first exemplary embodiment. First, in step S200, the controller 48 switches the amount of exposure to the amount of light for adjustment. In step S202, a ladder pattern serving as the adjustment pattern is formed on the photoconductor surface 50. Note that in step S202 of the second exemplary embodiment, an electrostatic latent image formed on the photoconductor surface 50 is developed by the developing device 18, and consequently a toner image is formed.

Subsequently, in step S204, the controller 48 obtains density values from a density sensor (any of the density sensors 81, 83, and 85) included in the image forming apparatus 10.

In step S206, the controller 48 calculates the average of the density values. In the second exemplary embodiment, plural density values (at plural positions) are obtained within a detection area. Thus, the controller 48 calculates the average of the obtained density values. Note that in the second exemplary embodiment, the calculated average is temporarily stored in a storage (not illustrated) such as a memory included in the controller 48.

Processing of step S208 and subsequent steps respectively correspond to processing of step S108 and subsequent steps of the focusing state adjustment process according to the first exemplary embodiment except that the average surface potential is used in the first exemplary embodiment but the average density value is used in the second exemplary embodiment.

In step S208, the controller 48 determines whether or not this is the first time the average has been calculated. If it is determined that this is the first time, the process proceeds to step S212. If it is determined that this is the second or subsequent time, the process proceeds to step S210. In step S210, the controller 48 determines whether or not "the previous average≥the current average" is satisfied. If the current average is smaller than or equal to the previous average, the process proceeds to step S212. In step S212, the expander lens 60 is moved. Then, the process returns to step S202, and steps of the process are repeated.

If it is determined in step S210 that the current average density value is larger than the previous average density value, the process proceeds to step S214. In step S214, it is determined that the previous position of the expander lens 60 is the optimum position at which the in-focus state is achieved. Subsequently, in step S216, the controller 48 moves the expander lens 60 to the optimum position, and then terminates the focusing state adjustment process.

As described above, in the second exemplary embodiment, the expander lens 60 is moved, and when any of the density of the toner image on the photoconductor surface 50, the density of the toner image on the transfer belt 100 resulting from first transfer, and the density of the toner image on the paper P resulting from second transfer becomes minimum, it is determined that the beam is focused. Specifically, in the second exemplary embodiment, the controller 48 switches the amount of exposure to the amount of light for adjustment, and then causes an electrostatic latent image of the adjustment pattern to be formed on the photoconductor surface 50. The electrostatic latent image formed on the photoconductor surface 50 is developed by the developing device 18, and consequently a toner image is formed. The controller 48 obtains density values from any of the density sensors 81, 83, and 85, calculates the average density value, and moves the expander lens 60. The controller 48 repeatedly forms the adjustment pattern, obtains density values, and moves the expander lens 60; and determines the position of the expander lens 60 at which the average density value becomes minimum as an optimum position, and moves the expander lens 60 to the optimum position.

Also, in the second exemplary embodiment, the focusing state is adjusted on the basis of density values detected by any of the density sensors 81, 83, and 85, without measuring line widths of the adjustment pattern. At least one of the density sensors 81, 83, and 85 is often included in general image forming apparatuses. Thus, like the first exemplary embodiment, the second exemplary embodiment enables, with a simple configuration, adjustment of the focusing state of the beam concentrated onto the photoconductor surface 50 by the optical scanning device 16.

Also, as in the first exemplary embodiment, in the image forming apparatus 10 according to the second exemplary embodiment, the focal position (focusing state) of the beam is adjusted onto the photoconductor surface 50, and thus a high-precision image is formed.

Third Exemplary Embodiment

The image forming apparatus 10, the optical scanning device 16, and the controller 48 according to a third exemplary embodiment include configurations and operations (processes) similar to the configurations and operations (processes) according to the first and second exemplary embodiments. Thus, this point is simply mentioned here and detailed descriptions of the similar configurations and operations (processes) are omitted.

In the first exemplary embodiment, a state in which the surface potential on the photoconductor surface 50 becomes minimum is considered as the in-focus state. In contrast, in the third exemplary embodiment, a state in which a degree of banding caused in an electrostatic latent image or a degree of banding caused in an image formed based on the electrostatic latent image becomes minimum is considered as the in-focus state.

Figure 15A:
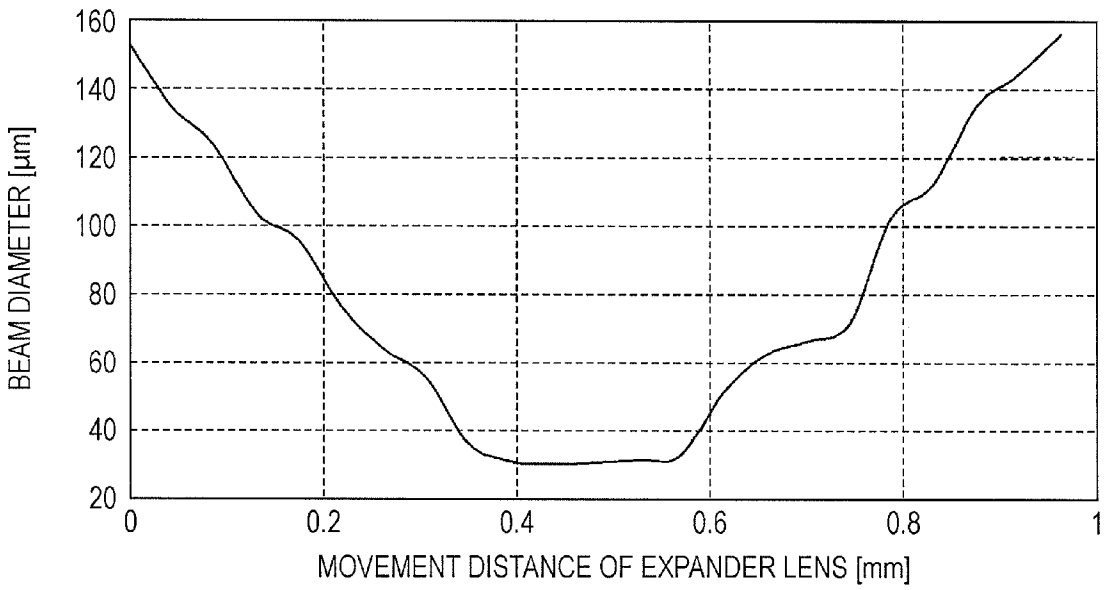
FIGS. 15A and 15B describe an example of movement of the expander lens in an image forming apparatus according to a third exemplary embodiment.
Figure 15B:
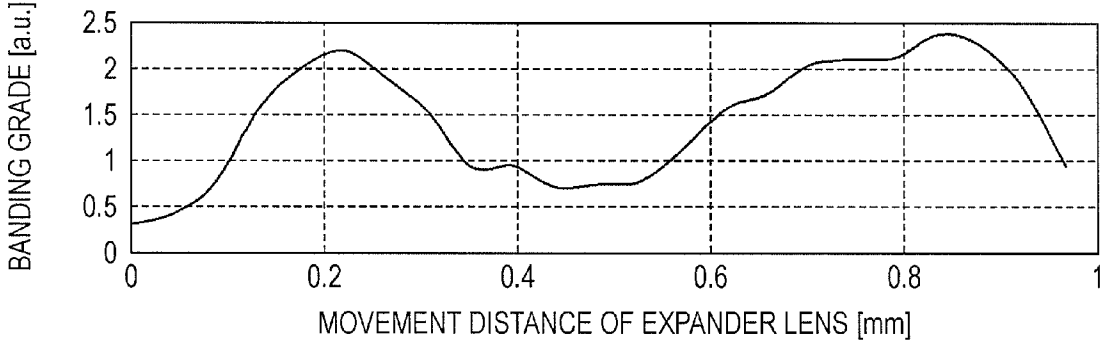

FIGS. 15A and 15B describe an example of movement of the expander lens 60 in the image forming apparatus 10 according to the third exemplary embodiment. FIG. 15A illustrates a graph representing a correspondence between a movement distance of the expander lens 60 and the beam diameter. FIG. 15B illustrates a graph representing a correspondence between the movement distance of the expander lens 60 and a banding grade which represents a degree of banding. Note that the larger the banding grade, the larger the degree of banding. In the third exemplary embodiment, the term "banding" refers to an image defect due to uneven density of a toner image. Banding is caused by uneven density of an electrostatic latent image formed on the photoconductor surface 50.

In general, banding is caused by the optical scanning device 16. Specifically, banding is caused by uneven widths of faces (six faces illustrated in FIG. 2 in the third exemplary embodiment) of the deflector 44, shaking of the deflector 44 when it rotates, and variations in the face reflectance. Compared with the case where the beam is focused on the photoconductor surface 50, in the case where the beam is not focused on the photoconductor surface 50, the influence of the aforementioned factors increases and the degree of banding caused becomes larger. Accordingly, as illustrated in FIGS. 15A and 15B, the position at which the beam diameter becomes minimum corresponds to the position at which the banding grade becomes minimum. Note that the banding grade at the original position is not taken into account in FIGS. 15A and 15B. In the third exemplary embodiment, the position at which the banding grade becomes minimum is considered as a position at which the in-focus state is achieved. The expander lens 60 is moved in order to detect this position.

A banding detection method is not limited to a specific method. The image forming apparatus 10 according to the third exemplary embodiment detects density of a toner image, and analyzes the detected density using fast Fourier transform (FFT) so as to detect banding.

Accordingly, the image forming apparatus 10 according to the third exemplary embodiment includes at least one of the density sensors 81, 83, and 85 (see FIGS. 12 and 13) as in the second exemplary embodiment. Density values read by the included density sensor are output to the controller 48. Also, the controller 48 according to the third exemplary embodiment has a function for performing FFT so as to analyze density values.

Figure 16:
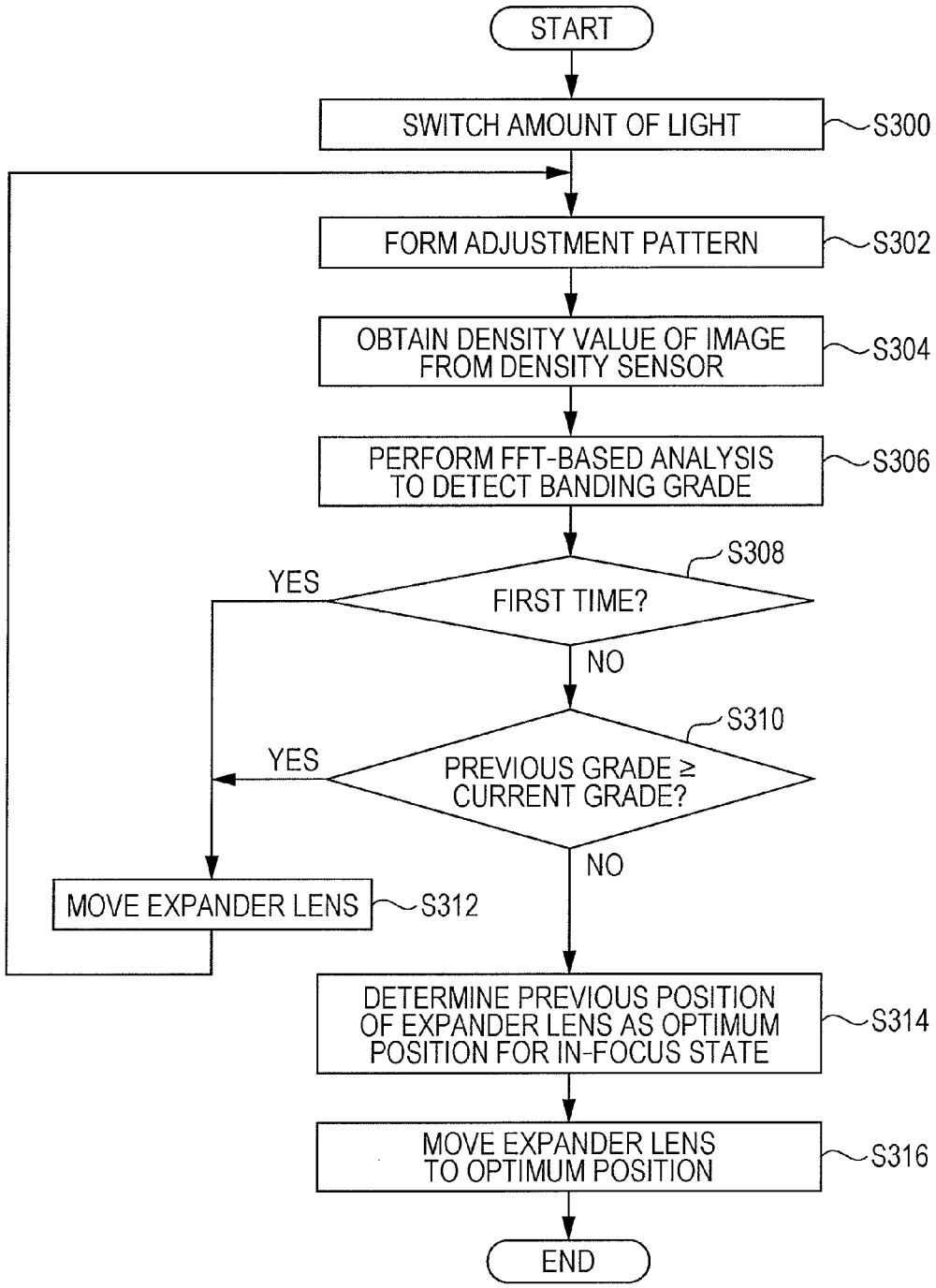
FIG. 16 is a flowchart of an example of the flow of a focusing state adjustment process executed by the controller in accordance with the third exemplary embodiment.

A focusing state adjustment process according to the third exemplary embodiment will be described. FIG. 16 illustrates a flowchart of an example of the flow of the focusing state adjustment process executed by the controller 48 in accordance with the third exemplary embodiment. The focusing state adjustment process according to the third exemplary embodiment includes processing steps similar to those of the focusing state adjustment process (see FIG. 9) according to each of the above-described exemplary embodiments. Thus, this point is simply mentioned here and a detailed description of the similar processing steps is omitted.

Steps S300 and S302 respectively correspond to steps S100 and S102 of the focusing state adjustment process according to the first exemplary embodiment. First, in step S300, the amount of exposure is switched to the amount of light for adjustment. Subsequently, in step S302, a ladder pattern serving as the adjustment pattern is formed on the photoconductor surface 50.

Subsequently, in step S304, the controller 48 obtains density values from a density sensor (any of the density sensors 81, 83, and 85) included in the image forming apparatus 10.

In step S306, the controller 48 analyzes the obtained density values using FFT so as to detect the banding grade. In the third exemplary embodiment, amplitude for a specific frequency, which is obtained in advance by experiments or the like, is monitored using FFT. The controller 48 compares the amplitude obtained based on the density values with target amplitude or the minimum value. Further, the controller 48 detects the banding grade on the basis of the comparison result. As the amplitude obtained based on the density values and the target amplitude or minimum value are closer to each other, the degree of banding becomes smaller and the banding grade becomes smaller.

In the third exemplary embodiment, the detected banding grade is temporarily stored in a storage (not illustrated) such as a memory included in the controller 48.

Processing of step S308 and subsequent steps respectively correspond to processing of step S108 and subsequent steps of the focusing state adjustment process according to the first exemplary embodiment except that the average surface potential on the photoconductor surface 50 is used in the first exemplary embodiment but the banding grade is used in the third exemplary embodiment.

In step S308, the controller 48 determines whether or not this is the first time the banding grade has been detected. If it is determined that this is the first time, the process proceeds to step S312. If it is determined that this is the second or subsequent time, the process proceeds to step S310.

In step S310, the controller 48 determines whether or not "the previous banding grade the current banding grade" is satisfied. If it is determined that the current banding grade is smaller than or equal to the previous banding grade, the process proceeds to step S312. In step S312, the expander lens 60 is moved. Then, the process returns to step S302, and steps of the process are repeated.

If it is determined in step S310 that the current banding grade is larger than the previous banding grade, the process proceeds to step S314. In step S314, the controller 48 determines that the previous position of the expander lens 60 is the optimum position at which the in-focus state is achieved. Subsequently, in step S316, the controller 48 moves the expander lens 60 to the optimum position, and then terminates the focusing state adjustment process.

As described above, in the third exemplary embodiment, the expander lens 60 is moved, and when a degree of banding of any of a toner image on the photoconductor surface 50, a toner image on the transfer belt 100 resulting from first transfer, and a toner image on the paper P resulting from second transfer becomes minimum, it is estimated that the beam is focused. Specifically, in the third exemplary embodiment, the controller 48 switches the amount of exposure to the amount of light for adjustment, and then causes an electrostatic latent image of an adjustment pattern to be formed on the photoconductor surface 50. The electrostatic latent image formed on the photoconductor surface 50 is developed by the developing device 18, and consequently a toner image is formed. The controller 48 obtains density values from any of the density sensors 81, 83, and 85, analyzes the density values using FFT to detect the banding grade, and moves the expander lens 60. The controller 48 repeatedly forms the adjustment pattern, obtains density values and detects the banding grade, and moves the expander lens 60; and determines the position of the expander lens 60 at which the banding grade becomes minimum as an optimum position, and moves the expander lens 60 to the optimum position.

Also, in the third exemplary embodiment, the focusing state is adjusted on the basis of density values detected by any of the density sensors 81, 83, and 85, without measuring line widths of the adjustment pattern. At least one of the density sensors 81, 83, and 85 are often included in general image forming apparatuses. Thus, like the first and second exemplary embodiments, the third exemplary embodiment enables, with a simple configuration, adjustment of the focusing state of the beam concentrated onto the photoconductor surface 50 by the optical scanning device 16.

Also, as in the first and second exemplary embodiments, in the image forming apparatus 10 according to the third exemplary embodiment, the focal position (focusing state) of the beam is adjusted onto the photoconductor surface 50, and thus a high-precision image is formed.

Fourth Exemplary Embodiment

The image forming apparatus 10, the optical scanning device 16, and the controller 48 according to a fourth exemplary embodiment include configurations and operations (processes) similar to the configurations and operations (processes) according to the first to third exemplary embodiments. Thus, this point is simply mentioned here and detailed descriptions of the similar configurations and operations (processes) are omitted.

As illustrated in FIG. 2, for example, for the photoconductor 12, a scanning angle of the polygon mirror is wide and the main-scanning-direction length is long. For this reason, aberration possibly causing field curvature may be caused at the respective ends in the main scanning direction. In the fourth exemplary embodiment, the image forming apparatus 10 having a function for adjusting field curvature will be described. In the fourth exemplary embodiment, the image forming apparatus 10 according to the first exemplary embodiment which adjusts the focusing state in accordance with a surface potential on the photoconductor surface 50 and which further includes a function for adjusting field curvature will be described.

Figure 17:
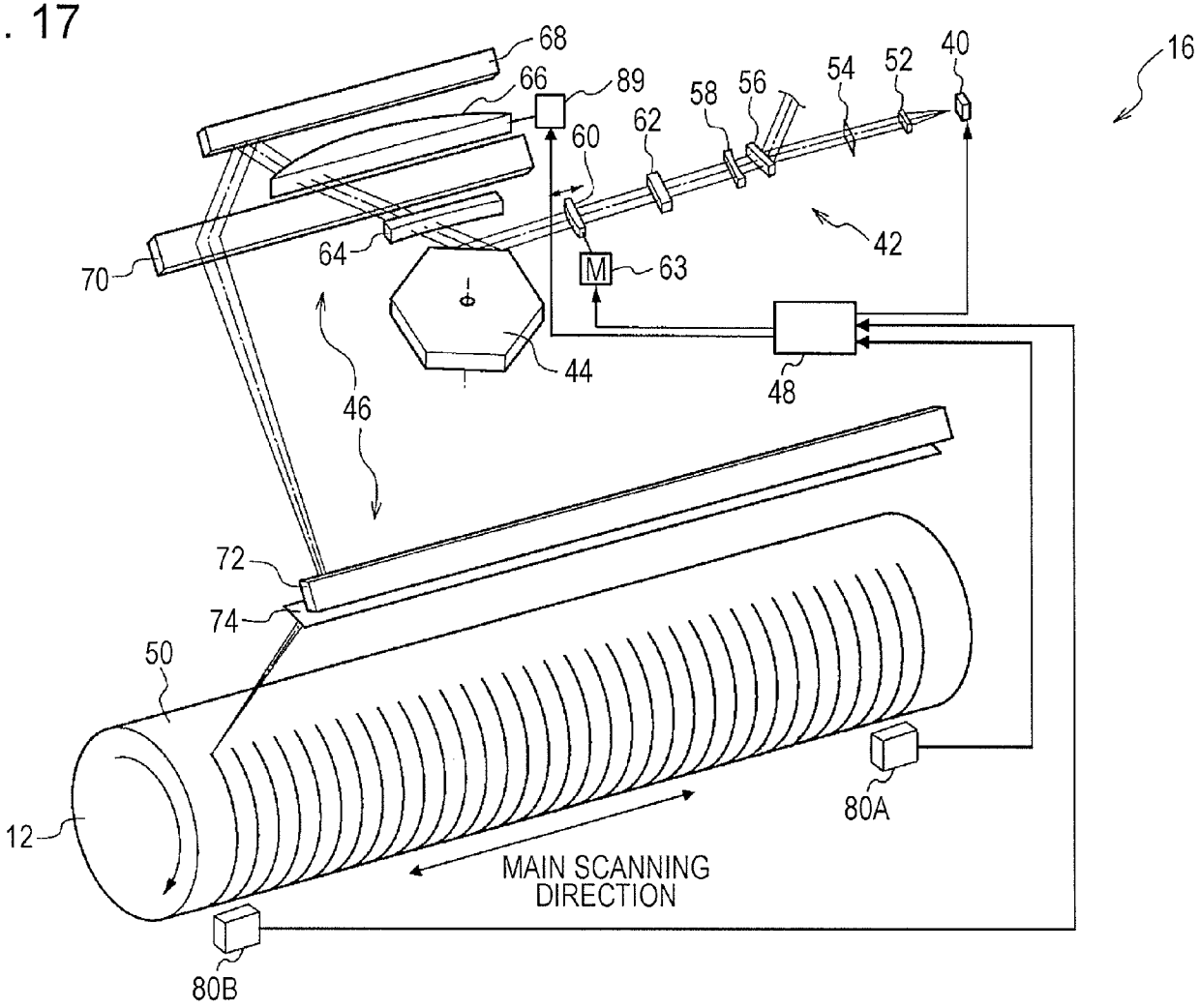
FIG. 17 illustrates a schematic configuration of an example of an optical scanning device according to a fourth exemplary embodiment.

In the image forming apparatus 10 according to the fourth exemplary embodiment, the configuration of the optical scanning device 16 to be adjusted or moved in order to adjust field curvature at the respective ends in the main scanning direction is not limited to a specific one; however, it is preferable that the angle of the fθ lens 64 or 66 be adjusted. Specifically, for example, field curvature is adjusted by adjusting the angle of the fθ lens 66 in the fourth exemplary embodiment. FIG. 17 illustrates a schematic configuration of an example of the optical scanning device 16 including a control device according to the fourth exemplary embodiment. The optical scanning device 16 according to the fourth exemplary embodiment differs from the optical scanning device 16 according to the first exemplary embodiment in that surface potential sensors 80A and 80B and an angle adjustment unit 89 are further included.

The surface potential sensors 80A and 80B are provided at respective positions corresponding to detection areas at the respective ends in order to detect surface potentials at the respective ends of the photoconductor surface 50. The term "respective ends" used herein does not refer to the respective ends of the photoconductor 12 but rather refers to respective ends of a portion in which an electrostatic latent image is formed. The detection areas of the surface potential sensors 80A and 80B each may include the corresponding end, or may be on the inner side of the end. The positions of the detection areas appropriate for adjustment of field curvature may be determined in advance by experiments or the like.

The angle adjustment unit 89 is electrically connected to the controller 48. Based on control of the controller 48, the angle adjustment unit 89 adjusts the angle of the fθ lens 66. Note that the angle adjustment unit 89 may be a motor or the like, just like the stepping motor 63.

Figure 18:
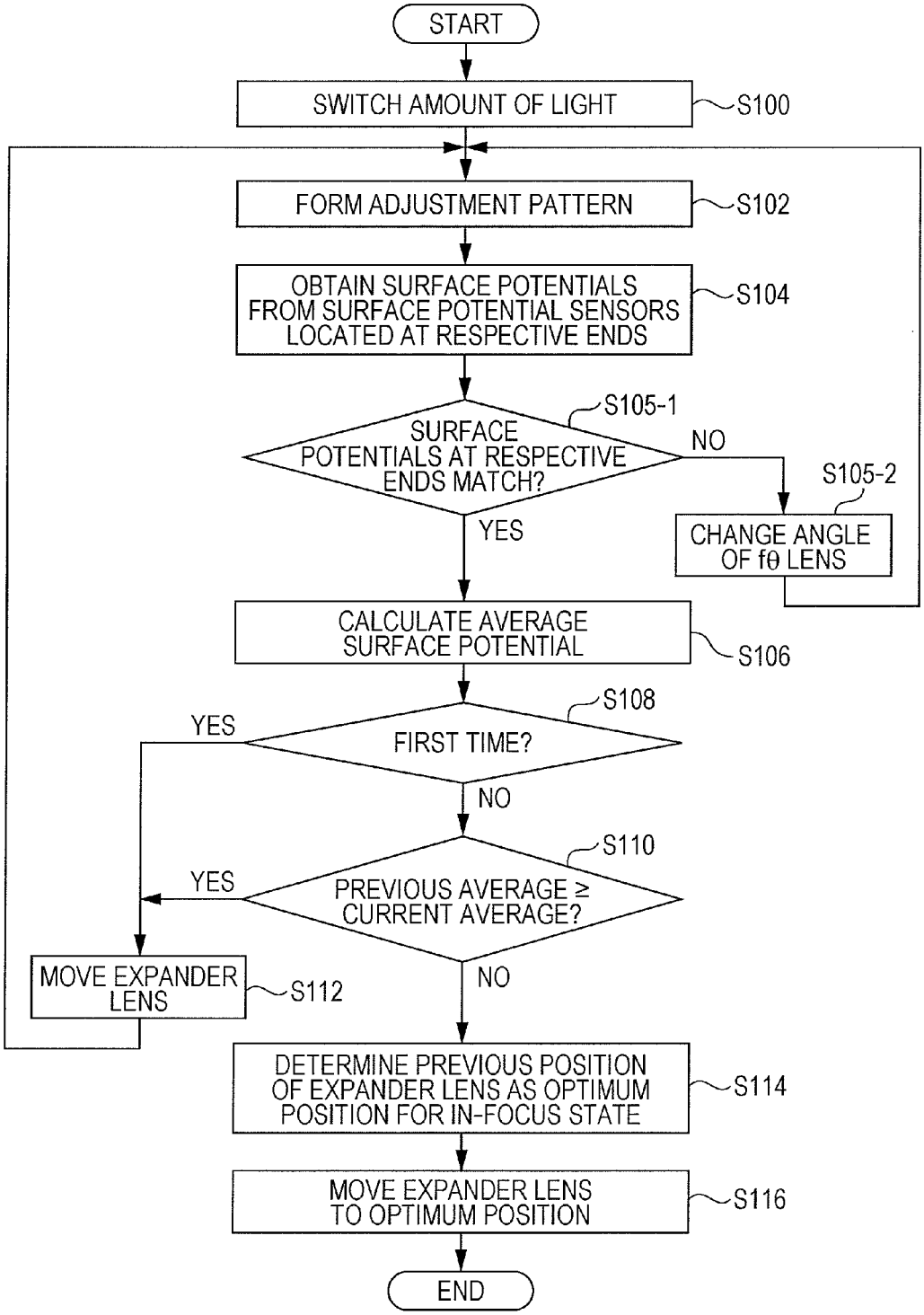
FIG. 18 is a flowchart of an example of the flow of a focusing state adjustment process executed by the controller in accordance with the fourth exemplary embodiment.

FIG. 18 illustrates a flowchart of an example of the flow of a focusing state adjustment process executed by the controller 48 in accordance with the fourth exemplary embodiment. The focusing state adjustment process according to the fourth exemplary embodiment differs from the focusing state adjustment process according to the first exemplary embodiment (see FIG. 9) in that steps S105-1 and S105-2 are further included between steps S104 and S106 of the focusing state adjustment process according to the first exemplary embodiment. Accordingly, processing of steps S105-1 and S105-2 will be described in detail here, and a detailed description of processing of the other steps is omitted.

Through processing of steps S100 to S104, the amount of exposure is switched to the amount of light for adjustment, a ladder pattern serving as the adjustment pattern is formed on the photoconductor surface 50, and surface potentials are obtained from the surface potential sensors 80A and 80B. Then, the process proceeds to step S105-1.

In step S105-1, the controller 48 determines whether or not the surface potentials at the respective ends are equal. As in step S106, in step S105-1, the controller 48 calculates an average surface potential in the detection area of the surface potential sensor 80A, and calculates an average surface potential in the detection area of the surface potential sensor 80B. Then, the controller 48 determines whether or not the (average) surface potentials at the respective ends are equal.

In the fourth exemplary embodiment, whether or not the surface potentials are equal is determined by calculating a difference or ratio between the surface potentials at the respective ends. In the case where a difference is calculated, if the difference is "0" or within a predetermined range that may be considered to be equal based on experiments or the like taking into consideration detection errors of the surface potential sensors 80A and 80B, it is determined that the surface potentials are equal. In the case where a ratio is calculated, if the ratio is "1" or within a predetermined range that may be considered to be equal based on experiments or the like taking into consideration detection errors of the surface potential sensors 80A and 80B, it is determined that the surface potentials are equal.

If it is determined that the surface potentials are not equal (NO), the process proceeds to step S105-2. In step S105-2, the controller 48 changes the angle of the fθ lens 66. Specifically, the controller 48 controls the angle adjustment unit 89 to change the angle of the fθ lens 66. An amount of change in the angle of the fθ lens 66 during one adjustment procedure is not limited to a specific value, and may be experimentally predetermined in advance.

After the angle of the fθ lens 66 is changed in step S105-2 in this way, the process returns to step S102, and steps of the process are repeated. A change in the angle of the fθ lens 66 changes aberration of the beam at the respective ends of the photoconductor surface 50 and ultimately changes the field curvature state. Because aberration of the beam at the respective ends of the photoconductor surface 50 is changed, processing for forming an electrostatic latent image on the photoconductor surface 50 and for detecting surface potentials at the respective ends of the photoconductor surface 50 is repeated.

If it is determined that the surface potentials at the respective ends of the photoconductor surface 50 are equal (YES in step S105-1), the process proceeds to step S106. As described above, after field curvature is adjusted by adjusting the angle of the fθ lens 66, the focusing state on the photoconductor surface 50 is adjusted as in the first exemplary embodiment. Accordingly, processing of step S106 and subsequent steps is the same as that of the first exemplary embodiment. Note that in step S106 of the fourth exemplary embodiment, an average of surface potentials obtained from the surface potential sensors 80A and 80B may be calculated or an average of surface potentials obtained from the surface potential sensor 80A or 80B may be calculated. Also, in steps subsequent to step S112 in which adjustment is performed for the second time, processing of steps S105-1 and S105-2 may be omitted.

As described above, like the first to third exemplary embodiments, the fourth exemplary embodiment enables, with a simple configuration, adjustment of the focusing state of the beam concentrated onto the photoconductor surface 50 by the optical scanning device 16. Also, as in the first to third exemplary embodiments, in the fourth exemplary embodiment, the focal position (focusing state) of the beam is adjusted onto the photoconductor surface 50, and thus a high-precision image is formed.

Further, in the fourth exemplary embodiment, the controller 48 obtains surface potentials at the respective ends of the photoconductor surface 50 from the surface potential sensors 80A and 80B, and adjusts the angle of the fθ lens 66 so that the potentials at the respective ends are balanced. Accordingly, in the fourth exemplary embodiment, field curvature due to aberration of the beam at the ends of the photoconductor surface 50 is reduced.

In the fourth exemplary embodiment, field curvature is adjusted before the focusing state is adjusted; however, the order of the adjustments is not limited to this one. Field curvature may be adjusted after the focusing state is adjusted, or field curvature may be adjusted before and after the focusing state is adjusted.

In the fourth exemplary embodiment, two surface potential sensors (surface potential sensors 80A and 80B) are used; however, the configuration is not limited to this example, and any configuration may be used as long as the configuration allows detection of surface potentials at the respective ends of the photoconductor surface 50. For example, the controller 48 may move one surface potential sensor 80 so as to detect surface potentials at the respective ends of the photoconductor surface 50.

The image forming apparatuses 10 according to the second and third exemplary embodiments may have the function for adjusting field curvature.

As described above, in the image forming apparatus 10 according to the first to fourth exemplary embodiments, the focusing state of the beam concentrated by the optical scanning device 16 on the photoconductor surface 50 may be adjusted with a simple configuration.

In the focusing state adjustment processes according to the first to fourth exemplary embodiment, the previous average or banding grade and the current average or banding grade are repeatedly compared with each other, and the position of the expander lens 60 at which the average or banding grade becomes minimum is determined as the optimum position; however, the configuration is not limited to this one. For example, the controller 48 may repeatedly perform processing for obtaining the average surface potential while moving the expander lens 60 and temporarily storing the average surface potential in association with the position of the expander lens 60 a predetermined number of times. Then, the controller 48 may determine the position of the expander lens 60 at which the average surface potential becomes minimum from among the stored average surface potentials, as the optimum position.

In the first to fourth exemplary embodiments described above, the case of adjusting the focusing state in the main scanning direction by moving the expander lens 60 has been described; however, the configuration is not limited to this one. For example, the focusing state may be adjusted by moving the collimator lens 52 or the light source 40, or the other lens or mirror, or the deflector 44 of the optical scanning device 16. For example, in the case where the focusing state in the sub-scanning direction is adjusted, the cylindrical lens 62 may be moved. Alternatively, for example, the focusing state may be adjusted by moving the entire optical scanning device 16.

Also, in the first to fourth exemplary embodiments described above, the case of adjusting the focusing state in the main scanning direction has been described; however, the configuration is not limited to this one. For example, the focusing state in the sub-scanning direction may be adjusted, or the focusing state in the main scanning direction and the sub-scanning direction may be adjusted.

Figure 19:
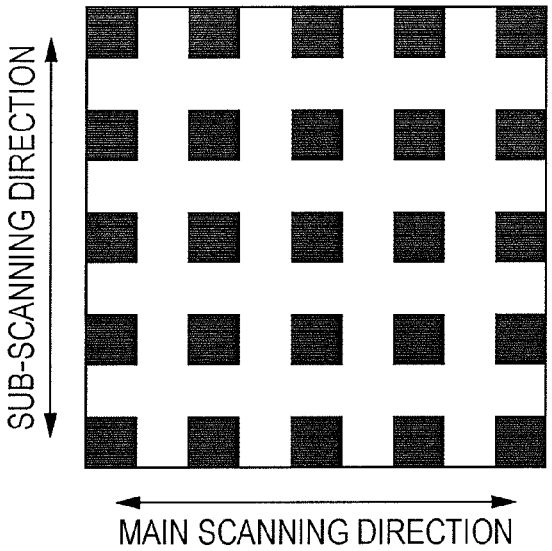
FIG. 19 illustrates another example of an adjustment pattern composed of squares.
Figure 20:
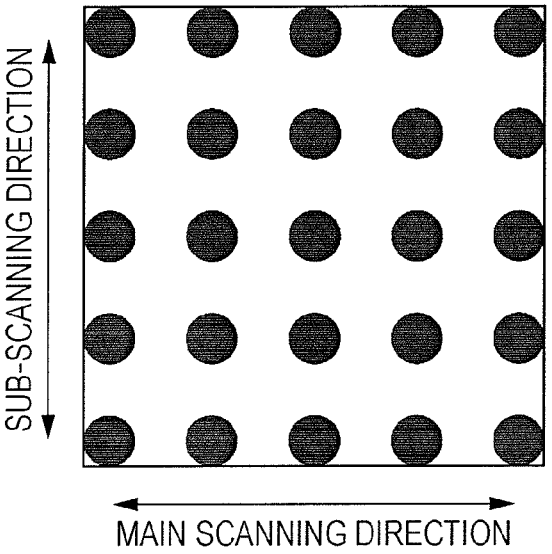
FIG. 20 illustrates another example of the adjustment pattern composed of circular dots.
Figure 21:
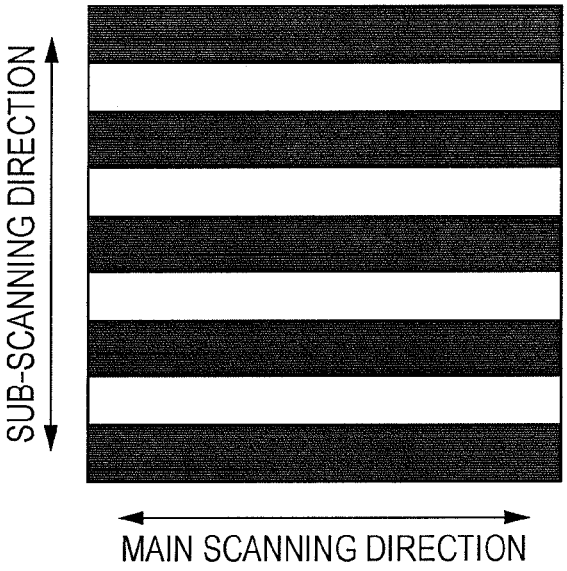
FIG. 21 illustrates another example of the adjustment pattern composed of lines extending in the main scanning direction.
Figure 22:
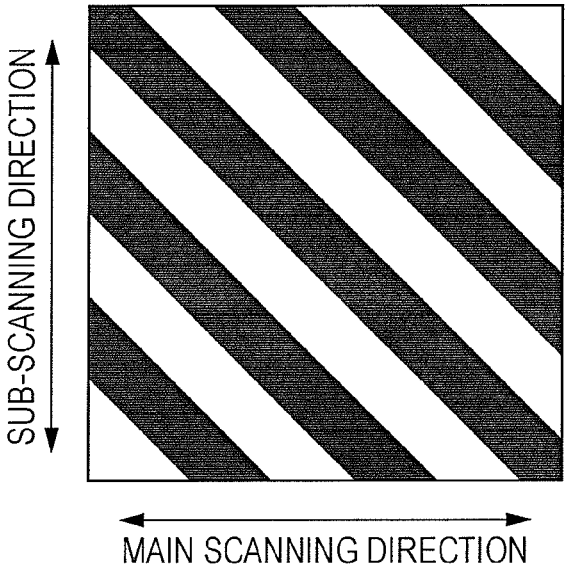
FIG. 22 illustrates another example of the adjustment pattern composed of diagonally extending lines.

In the first to fourth exemplary embodiments described above, a ladder pattern composed of lines extending in the sub-scanning direction is used as the adjustment pattern; however, the adjustment pattern is not limited to this one. FIGS. 19 and 20 illustrate other examples of the adjustment pattern. For example, the adjustment pattern may be composed of squares as illustrated in FIG. 19, or circular dots as illustrated in FIG. 20. Also, in the case of adjusting the focusing state in the sub-scanning direction as described above, it is preferable that the adjustment pattern be composed of lines extending in the main scanning direction as illustrated in FIG. 21. Also, in the case of adjusting the focusing state in the main scanning direction and the sub-scanning direction, it is preferable that the adjustment pattern be composed of diagonally extending lines as illustrated in FIG. 22.

In the first to third exemplary embodiments described above, the case of adjusting the focusing state on the basis of information detected in one detection area has been described; however, the configuration is not limited to this one. For example, the adjustment may be performed on the basis of surface potentials detected in multiple detection areas of the photoconductor 12 in the main scanning direction and the sub-scanning direction. Also, the size of each detection area is not limited to the one described in the above-described exemplary embodiments. For example, the detection area may extend over the entire area in at least one of the main scanning direction and the sub-scanning direction of the photoconductor surface 50. As the number of detection areas or the size of the detection area becomes larger, the adjustment precision improves but the adjustment takes a longer period. Thus, the number of detection areas or the size of the detection area may be determined in accordance with a desired precision and property, for example.

The case has been described in which the exemplary embodiments are applied to the optical scanning device 16 including the light source 40 which is a VCSEL and includes multiple light emitting points in the image forming apparatus 10 according to the above-described exemplary embodiments; however, the configuration is not limited to this one. For example, the exemplary embodiments may be applied to an optical scanning device which includes a light source including a single light emitting point. Also, the exemplary embodiments may be applied to a light emitting diode (LED) print head which uses LEDs as the light source. Even in the case where the optical scanning device is an LED print head, the light source, various lenses included in the LED print head, or the entire LED print head is movable.

The above-described exemplary embodiments are merely examples of the present invention, and it is obvious that alterations may occur in accordance with circumstances within a scope not departing from the gist of the present invention. The configurations and operations of the image forming apparatus 10, the optical scanning device 16, the controller 48, and so on described in the exemplary embodiments are merely examples, and it is obvious that alterations may occur in accordance with circumstances within a scope not departing from the gist of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image forming unit that includes a light source and a condenser, the latent image forming unit being configured to concentrate a beam emitted from the light source onto a surface of a photoconductor and form a latent image on the surface of the photoconductor;

a developing unit configured to develop the latent image on the surface of the photoconductor to form a toner image;

a transfer unit configured to transfer the toner image on the surface of the photoconductor onto a transferred-image receiving member;

a detector configured to detect at least one of a potential of the latent image and a density of the toner image, wherein the detector is an electrostatic voltmeter (ESV) sensor configured to detect a potential of a latent image formed on the surface of the photoconductor;

an adjustment unit configured to adjust a focusing state of the concentrated beam on the photoconductor; and a controller configured to control the adjustment unit in accordance with the detection.

2. The image forming apparatus according to claim 1, wherein the detector is a potential detector configured to detect a potential of a latent image formed on the surface of the photoconductor.

3. The image forming apparatus according to claim 2, wherein the potential detector is configured to detect potentials of latent images formed in different focusing states achieved by the adjustment unit, and the controller is configured to control the adjustment unit so as to achieve a state in which a latent image with the lowest potential among the detected potentials has been formed.

4. The image forming apparatus according to claim 2, wherein the controller is configured to control the adjustment unit so that the focusing state of the concentrated beam on the photoconductor is adjusted in accordance with an average of potentials of the latent image detected by the potential detector.

5. The image forming apparatus according to claim 2, wherein the latent image forming unit includes a scanning unit configured to perform scanning using a beam emitted from the light source and a lens that adjusts a depth-direction position of the beam on the surface of the photoconductor, and perform scanning using a concentrated beam, the potential detector is configured to detect a first potential in a first area corresponding to a first end of the latent image in a scanning direction and a second potential in a second area corresponding to a second end of the latent image in the scanning direction, and the controller is configured to control, via the adjustment unit, the focusing state so that a difference or ratio between the first potential and the second potential detected by the potential detector in the first area and the second area, respectively, is within a predetermined range.

6. The image forming apparatus according to claim 2, wherein the potential detector is configured to detect unevenness in potential of the latent image.

7. The image forming apparatus according to claim 1, wherein the detector is a density detector configured to detect a density of a toner image on the surface of the photoconductor or a transferred toner image on the transferred-image receiving member.

8. The image forming apparatus according to claim 7, wherein the density detector is configured to detect densities of toner images formed in different focusing states achieved by the adjustment unit, and the controller is configured to control the adjustment unit so as to achieve a state in which a toner image with the smallest density among the detected densities has been formed.

9. The image forming apparatus according to claim 7, wherein the controller is configured to control the adjustment unit so that the focusing state of the concentrated beam on the photoconductor is adjusted in accordance with an average of densities of the toner image detected by the density detector.

10. The image forming apparatus according to claim 7, wherein the density detector is configured to detect a first density in a first area corresponding to a first end of the toner image in a direction perpendicular to a transportation direction in which the transferred-image receiving member is transported and a second density in a second area corresponding to a second end of the toner image in the direction perpendicular to the transportation direction, and the controller is configured to control, via the adjustment unit, the focusing state so that a difference or ratio between the first density and the second density detected by the density detector in the first area and the second area, respectively, is within a predetermined range.

11. The image forming apparatus according to claim 7, wherein the density detector is configured to detect unevenness in density of the toner image.

12. The image forming apparatus according to claim 1, wherein the latent image forming unit is configured to form any of a first adjustment pattern, a second adjustment pattern, and a third adjustment pattern, the first adjustment pattern being used to adjust the focusing state in a perpendicular direction which is perpendicular to a rotation direction in which the photoconductor rotates, the second adjustment pattern being used to adjust the focusing state in the rotation direction, and the third adjustment pattern being used to adjust the focusing state in the perpendicular direction and the rotation direction.

13. An image forming method comprising:

concentrating a beam emitted from a light source onto a surface of a photoconductor and forming a latent image on the surface of the photoconductor;

developing the latent image on the surface of the photoconductor to form a toner image;

transferring the toner image on the surface of the photoconductor onto a transferred-image receiving member;

detecting a potential of the latent image or a density of the toner image by an electrostatic voltmeter (ESV) sensor configured to detect a potential of the latent image formed on the surface of the photoconductor;

adjusting a focusing state of the concentrated beam on the photoconductor; and performing control in accordance with a result of detecting the potential of the latent image or the density of the toner image.

14. The image forming method according to claim 13, wherein the detecting includes detecting potentials latent images formed in different focusing states achieved by the adjusting, and the adjusting is controlled so as to achieve a state in which a latent image with the lowest potential among the detected potentials has been formed.

15. The image forming method according to claim 13, wherein the potential of the latent image formed on the surface of the photoconductor is detected, and the adjusting is controlled so that the focusing state of the concentrated beam on the photoconductor is adjusted in accordance with an average of potentials of the latent image detected by the potential detector.

16. The image forming method according to claim 13, wherein the potential of the latent image formed on the surface of the photoconductor is detected, and the method further comprises:

scanning using a beam emitted from the light source and a lens that adjusts a depth-direction position of the beam on the surface of the photoconductor, and scanning using a concentrated beam;

detecting a first potential in a first area corresponding to a first end of the latent image in a scanning direction and a second potential in a second area corresponding to a second end of the latent image in the scanning direction, and controlling, via the adjusting, the focusing state so that a difference or ratio between the first potential and the second potential detected by the potential detector in the first area and the second area, respectively, is within a predetermined range.

17. A non-transitory computer readable medium storing a program causing a computer to execute a process for controlling an image forming apparatus, the process comprising:

concentrating a beam emitted from a light source onto a surface of a photoconductor and forming a latent image on the surface of the photoconductor;

developing the latent image on the surface of the photoconductor to form a toner image;

transferring the toner image on the surface of the photoconductor onto a transferred-image receiving member;

detecting a potential of the latent image or a density of the toner image by an electrostatic voltmeter (ESV) sensor configured to detect a potential of the latent image formed on the surface of the photoconductor;

adjusting a focusing state of the concentrated beam on the photoconductor; and performing control in accordance with a result of detecting the potential of the latent image or the density of the toner image.

18. The non-transitory computer readable medium according to claim 17, wherein the detecting includes detecting potentials latent images formed in different focusing states achieved by the adjusting, and the adjusting is controlled so as to achieve a state in which a latent image with the lowest potential among the detected potentials has been formed.

19. The non-transitory computer readable medium according to claim 17, wherein the potential of the latent image formed on the surface of the photoconductor is detected, and the adjusting is controlled so that the focusing state of the concentrated beam on the photoconductor is adjusted in accordance with an average of potentials of the latent image detected by the potential detector.

20. The non-transitory computer readable medium according to claim 17, wherein the potential of the latent image formed on the surface of the photoconductor is detected, and the process further comprises:

scanning using a beam emitted from the light source and a lens that adjusts a depth-direction position of the beam on the surface of the photoconductor, and scanning using a concentrated beam;

detecting a first potential in a first area corresponding to a first end of the latent image in a scanning direction and a second potential in a second area corresponding to a second end of the latent image in the scanning direction, and controlling, via the adjusting, the focusing state so that a difference or ratio between the first potential and the second potential detected by the potential detector in the first area and the second area, respectively, is within a predetermined range.

* * * * *